US009933712B2

(12) United States Patent
Ogata et al.

(10) Patent No.: US 9,933,712 B2
(45) Date of Patent: Apr. 3, 2018

(54) MULTI-LAYER ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Akihiko Ogata, Osaka (JP); Hideki Okada, Osaka (JP); Jun Azuma, Osaka (JP); Kensuke Okawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/247,373

(22) Filed: Aug. 25, 2016

(65) Prior Publication Data

US 2017/0060006 A1 Mar. 2, 2017

(30) Foreign Application Priority Data

Aug. 31, 2015 (JP) ..... 2015-170504

(51) Int. Cl.

*G03G 5/06* (2006.01)
*G03G 5/05* (2006.01)
*G03G 5/047* (2006.01)

(52) U.S. Cl.

CPC ..... *G03G 5/0614* (2013.01); *G03G 5/047* (2013.01); *G03G 5/0525* (2013.01); *G03G 5/0564* (2013.01); *G03G 5/0609* (2013.01); *G03G 5/0672* (2013.01); *G03G 5/0696* (2013.01)

(58) Field of Classification Search

CPC .. G03G 5/0614; G03G 5/0564; G03G 5/0607; G03G 5/0605

See application file for complete search history.

(56) References Cited

U.S. PATENT DOCUMENTS 6,284,420 B1 * 9/2001 Liu ..... C09B 67/0016 430/59.5
8,859,818 B2 10/2014 Nakamura et al.
9,690,217 B2 * 6/2017 Okada ..... G03G 5/04
2011/0206411 A1 * 8/2011 Mizushima ..... G03G 5/04 399/111
2012/0022293 A1 1/2012 Nakamura et al.
2013/0330663 A1 * 12/2013 Kawasaki ..... G03G 5/10 430/57.1
2015/0118608 A1 * 4/2015 Azuma ..... G03G 5/0618 430/58.25
2016/0062253 A1 * 3/2016 Okada ..... G03G 5/04 430/56

FOREIGN PATENT DOCUMENTS

JP 06266136 A * 9/1994
JP 2008024656 A * 2/2008
JP 2008063230 A * 3/2008
JP 2008127289 A * 6/2008
JP 2009169180 A * 7/2009
JP 2010185955 A * 8/2010
JP 2012-027139 A 2/2012

OTHER PUBLICATIONS

English language machine translation of JP 2010-185955 (Aug. 2010).*
English language machine translation of JP 06-266136 (Sep. 1994).*

* cited by examiner

*Primary Examiner* — Christopher D Rodee
(74) *Attorney, Agent, or Firm* — Studebaker & Brackett PC

(57) ABSTRACT

A multi-layer electrophotographic photosensitive member includes a conductive substrate and a photosensitive layer. The photosensitive layer includes a charge generating layer and a charge transport layer. The charge generating layer contains a charge generating material. The charge transport layer contains a hole transport material and a binder resin. The charge generating material contains a titanyl phthalocyanine that exhibits a main peak at a Bragg angle (2θ±0.2°) of 27.2° in a CuKα characteristic X-ray diffraction spectrum. The hole transport material contains a triarylamine derivative represented by generic formula (1). The hole transport material has a mass ratio of at least 0.30 and no greater than 0.55 relative to the binder resin in the charge transport layer. In general formula (1), $R_1$, $R_2$, l, and m are the same as those defined in the specification.

(1)

8 Claims, 3 Drawing Sheets

MULTI-LAYER ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2015-170504, filed Aug. 31, 2015. The contents of this application are incorporated herein by reference in their entirety.

BACKGROUND

The present disclosure relates to a multi-layer electrophotographic photosensitive member, a process cartridge, and an image forming apparatus.

An electrophotographic photosensitive member is used as an image bearing member in an electrographic image forming apparatus (for example, a printer or a multifunction peripheral). Typically, the electrophotographic photosensitive member includes a photosensitive layer. The photosensitive layer can contain a charge generating material, a charge transport material (for example, a hole transport material or an electron transport material), and a resin (binder resin) for binding the charging generating material and the charge transport material together. An electrophotographic photosensitive member including a photosensitive layer such as above is called an organic electrophotographic photosensitive member. The photosensitive layer may include a charge generating layer having a charge generating function and a charge transport layer having a charge transporting function. An electrophotographic photosensitive member such as above is called a multi-layer electrophotographic photosensitive member.

One known example of the hole transport material for transporting holes that is applicable to a multi-layer organic electrophotographic photosensitive member is a tris(4-styrylphenyl)amine derivative.

SUMMARY

A multi-layer electrophotographic photosensitive member according to the present disclosure includes a conductive substrate and a photosensitive layer. The photosensitive layer includes a charge generating layer and a charge transport layer. The charge generating layer contains a charge generating material. The charge transport layer contains a hole transport material and a binder resin. The charge generating material contains a titanyl phthalocyanine that exhibits a peak at a Bragg angle (2θ±0.2°) of 27.2° in a CuKα characteristic X-ray diffraction spectrum. The hole transport material contains a triarylamine derivative represented by generic formula (1). The hole transport material has a mass ratio of at least 0.30 and no greater than 0.55 relative to the binder resin in the charge transport layern.

(1)

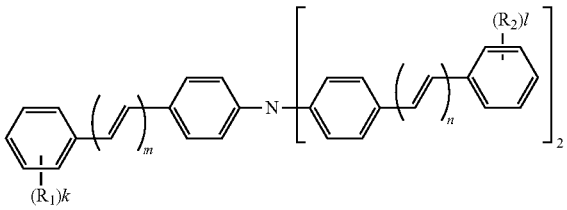

In general formula (1), $R_1$ and $R_2$ each represent, independently of one another, a halogen atom, an optionally substituted alkyl group having a carbon number of at least 1 and no greater than 6, an optionally substituted alkoxy group having a carbon number of at least 1 and no greater than 6, or an optionally substituted aryl group having a carbon number of at least 6 and no greater than 12. Furthermore, k and l each represent, independently of one another, an integer of at least 0 and no greater than 4. When k represents an integer greater than 1, a plurality of chemical groups $R_1$ bonded to the same aromatic ring are the same as or different from one another. When l represents an integer greater than 1, a plurality of chemical groups $R_2$ bonded to the same aromatic ring are the same as or different from one another. Further, m and n each represent, independently of one another, an integer of at least 1 and no greater than 3 and represent integers different from each other.

A process cartridge according to the present disclosure includes the above multi-layer electrophotographic photosensitive member.

An image forming apparatus according to the present disclosure includes an image bearing member, a charger, a light exposure section, a developing section, and a transfer section. The image bearing member is the above electrophotographic photosensitive member. The charger charges a surface of the image bearing member. The light exposure section forms an electrostatic latent image on the surface of the image bearing member. The development section develops the electrostatic latent image into a toner image. The transfer section transfers the toner image to a transfer target from the image bearing member.

DETAILED DESCRIPTION

Figure 1A:
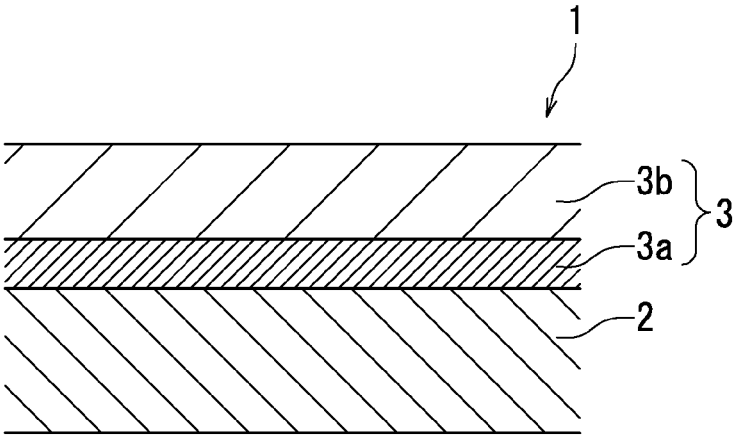
FIGS. 1A-1C each are a schematic cross sectional view illustrating a configuration of a multi-layer electrophotographic photosensitive member according to a first embodiment.

The following describes embodiments of the present disclosure in detail. The present disclosure is of course not in any way limited by the following embodiments and appropriate alterations may be made in practice within the intended scope of the present disclosure. Although explanation is omitted as appropriate in order to avoid repetition, such omission does not limit the essence of the present disclosure. Note that in the present description the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Where a substituent may have an additional substituent, the number of carbon atoms of the substitute does not include the number of carbon atoms of the additional substituent. For example, the number of carbon atoms of 1-methoxy-naphthyl group is 10.

A halogen atom, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, an alkoxy group having a carbon number of at least 1 and no greater than 6, an alkoxy group having a carbon number of at least 1 and no greater than 4, an alkoxy group having a carbon number of at least 1 and no greater than 3, a cycloalkylidene group having a carbon number of at least 5 and no greater than 7, and an aryl group having a carbon number of at least 6 and no greater than 12 are defined as follows unless otherwise state.

Examples of halogen atoms that can be represented include a fluorine atom, a chlorine atom, a bromine atom, and an iodine atom.

The alkyl group having a carbon number of at least 1 and no greater than 6 is a straight chain or branched non-substituent. Examples of alkyl groups having a carbon number of at least 1 and no greater than 6 that can be represented include a methyl group, an ethyl group, a propyl group, an isopropyl group, an n-butyl group, a tert-butyl group, an n-pentyl group, an isopentyl group, a neopentyl group, and a hexyl group.

The alkyl group having a carbon number of at least 1 and no greater than 5 is a straight chain or branched non-substituent. Examples of alkyl groups having a carbon number of at least 1 and no greater than 5 that can be represented include a methyl group, an ethyl group, a propyl group, an isopropyl group, an n-butyl group, a tert-butyl group, an n-pentyl group, an isopentyl group, and a neopentyl group.

The alkyl group having a carbon number of at least 1 and no greater than 4 is a straight chain or branched non-substituent. Examples of alkyl groups having a carbon number of at least 1 and no greater than 4 that can be represented include a methyl group, an ethyl group, a propyl group, an isopropyl group, an n-butyl group, and a tert-butyl group.

The alkyl group having a carbon number of at least 1 and no greater than 3 is a straight chain or branched non-substituent. Examples of alkyl groups having a carbon number of at least 1 and no greater than 3 that can be represented include a methyl group, an ethyl group, a propyl group, and an isopropyl group.

The alkoxy group having a carbon number of at least 1 and no greater than 6 is a straight chain or branched non-substituent. Examples of alkoxy groups having a carbon number of at least 1 and no greater than 6 that can be represented include a methoxy group, an ethoxy group, an n-propoxy group, an isopropoxy group, an n-butoxy group, a sec-butoxy group, a tert-butoxy group, an n-pentoxy group, an isopentoxy group, a neopentoxy group, and a hexoxy group.

The alkoxy group having a carbon number of at least 1 and no greater than 5 is a straight chain or branched non-substituent. Examples of alkoxy groups having a carbon number of at least 1 and no greater than 5 that can be represented include a methoxy group, an ethoxy group, an n-propoxy group, an isopropoxy group, an n-butoxy group, a sec-butoxy group, a tert-butoxy group, an n-pentoxy group, an isopentoxy group, and a neopentoxy group.

The alkoxy group having a carbon number of at least 1 and no greater than 4 is a straight chain or branched non-substituent. Examples of alkoxy groups having a carbon number of at least 1 and no greater than 4 that can be represented include a methoxy group, an ethoxy group, an n-propoxy group, an isopropoxy group, an n-butoxy group, a sec-butoxy group, and a tert-butoxy group.

The alkoxy group having a carbon number of at least 1 and no greater than 3 is a straight chain or branched non-substituent. Examples of alkoxy groups having a carbon number of at least 1 and no greater than 3 that can be represented include a methoxy group, an ethoxy group, an n-propoxy group, and an isopropoxy group.

The cycloalkylidene group having a carbon number of at least 5 and no greater than 7 is a straight chain or branched non-substituent. Examples of cycloalkylidene groups having a carbon number of at least 5 and no greater than 7 that can be represented include a cyclopentylidene group, a cyclohexylidene group, and a cycloheptylidene group.

Examples of aryl groups having a carbon number of at least 6 and no greater than 12 that can be represented include a phenyl group and a naphthyl group.

<First Embodiment: Multi-Layer Electrophotographic Photosensitive Member>

Figure 1B:
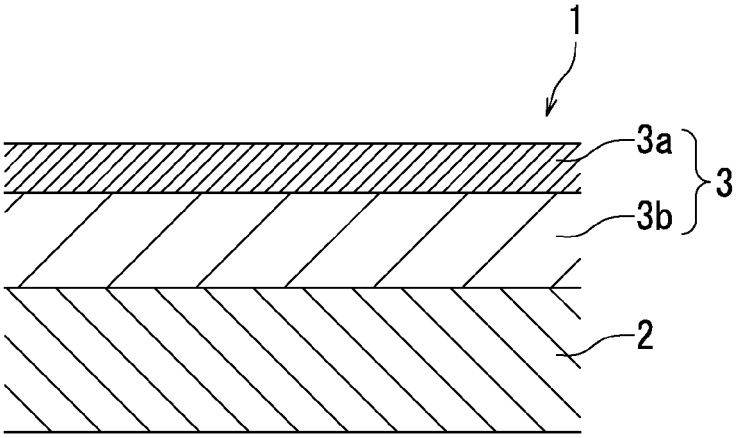
Figure 1C:
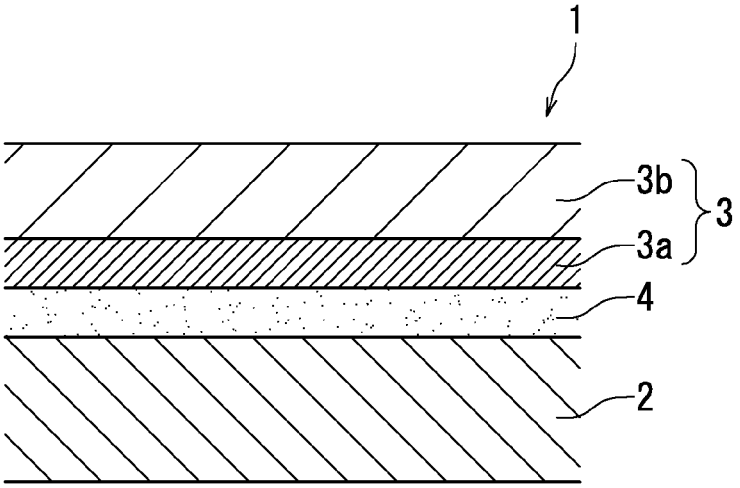

A first embodiment is directed to a multi-layer electrophotographic photosensitive member (also referred to below as a photosensitive member). The photosensitive member according to the first embodiment will be described with reference to FIGS. 1A-1C. FIGS. 1A-1C each are a schematic cross-sectional view illustrating a configuration of a multi-layer electrophotographic photosensitive member according to the first embodiment. The photosensitive member 1 includes for example a conductive substrate 2 and a photosensitive layer 3 as illustrated in FIG. 1A. The photosensitive layer 3 may be disposed for example directly on the conductive substrate 2 as illustrated in FIG. 1A. The photosensitive layer 3 includes a charge generating layer 3*a* and a charge transport layer 3*b*. As illustrated in FIG. 1A, the charge generating layer 3*a* may be disposed on the conductive substrate 2 and the charge transport layer 3*b* may be disposed on the charge generating layer 3*a* in the photosensitive member 1. As illustrated in FIG. 1B, the charge transport layer 3*b* may be disposed on the conductive substrate 2 and the charge generating layer 3*a* may be disposed on the charge transport layer 3*b*. The charge transport layer 3*b* is preferably disposed on the charge generating layer 3*a* in the photosensitive member 1, as illustrated in FIG. 1A.

Alternatively, the photosensitive member 1 may include an intermediate layer (specifically, undercoat layer or the like) 4 in addition to the conductive substrate 2 and the photosensitive layer 3, as illustrated in FIG. 1C, for example. The intermediate layer (undercoat layer) 4 may be appropriately disposed for example between the conductive substrate 2 and the photosensitive layer 3 as illustrated in FIG. 1C. A protective layer may be disposed on the photosensitive layer 3.

The photosensitive member 1 according to the first embodiment is excellent in electrical characteristics (chargeability and sensitivity characteristics) and abrasion resistance. The reason thereof may be considered as follows. In the photosensitive member 1 according to the first embodiment, the photosensitive layer 3 includes a charge generating layer 3*a* that contains a charge generating material and a charge transport layer 3*b* that contains a hole transport material and a binder resin. The hole transport material contains a triarylamine derivative represented by general formula (1) (also referred to below as a triarylamine derivative (1)). In the triarylamine derivative (1), m and n represent integers different from one another. In other words, one of three phenylalkylene groups introduced in triphenylamine is different in structure from the other two phenylalkylene groups. The triarylamine derivative (1) having such an asymmetric structure is considered to be excellent in dispersibility in a solvent and compatibility with a binder resin. For this reason, an application liquid for charge transport layer formation in which the triarylamine derivative (1) is uniformly dispersed can be prepared, with a result of tendency in which the charge transport layer 3*b* containing the uniformly dispersed triarylamine derivative (1) can be formed. Therefore, the photosensitive member 1 according to the first embodiment can be considered to be excellent in chargeability and sensitivity characteristics.

Furthermore, the hole transport material contains the triarylamine derivative (1). The hole transport material has a ratio of a mass (content) of at least 0.30 and no greater than 0.55 relative to the mass (content) of the binder resin in the charge transport layer 3*b*. The triarylamine derivative (1) is excellent in electrical characteristics, and therefore, the content of the triarylamine derivative (1) in the charge transport layer can be reduced. As a result, the triarylamine derivative (1) is considered to increase layer density of the charge transport layer 3*b* in cooperation with the binder resin to increase film strength of the charge transport layer 3*b*. Therefore, the photosensitive member 1 according to the first embodiment is considered to be excellent in abrasion resistance.

Following describes the conductive substrate 2, the photosensitive layer 3, and the intermediate layer 4.

[1. Conductive Substrate]

No specific limitation is placed on the conductive substrate 2 as long as it can be used as a conductive substrate of the photosensitive member 1. The conductive substrate 2 can for example be a conductive substrate in which at least a surface portion thereof is made from a conductive material. Examples of the conductive substrate 2 include a conductive substrate made from a conductive material and a conductive substrate covered with a conductive material. Examples of conductive materials that can be used include aluminum, iron, copper, tin, platinum, silver, vanadium, molybdenum, chromium, cadmium, titanium, nickel, palladium, and indium. Any one of the conductive materials listed above may be used, or a combination of any two or more of the conductive materials listed above may be used. An example of combinations of two or more of the conductive materials listed above may be an alloy (more specifically, an aluminum alloy, stainless steel, or brass). Among the conductive materials listed above, aluminum or an aluminum alloy is preferable in terms of excellent charge mobility from the photosensitive layer 3 to the conductive substrate 2.

The shape of the conductive substrate 2 can be selected appropriately in accordance with the structure of an image forming apparatus in which the conductive substrate is to be used. The conductive substrate 2 may have a shape such as a sheet shape or a drum shape. The thickness of the conductive substrate 2 can be selected appropriately in accordance with the shape of the conductive substrate 2.

[2. Photosensitive Layer]

As is already described, the photosensitive layer 3 includes the charge generating layer 3*a* and the charge transport layer 3*b*. Following describes the charge generating layer 3*a* and the charge transport layer 3*b*. The photosensitive layer 3 may optionally contain an additive. The additive will be described later.

[2-1. Charge Generating Layer]

The charge generating layer 3*a* contains for example a charge generating material and a charge generation layer binder resin (also referred to below as a base resin). No particular limitation is placed on the thickness of the charge generating layer 3*a* as long as it can satisfactorily work as a charge generating layer. Specifically, the thickness of the charge generating layer 3*a* is preferably at least 0.01 μm and no greater than 5 μm, and more preferably at least 0.1 m and no greater than 3 μm. The charge generating material and the base resin will be described below.

[2-1-1. Charge Generating Material]

The charge generating material contains a titanyl phthalocyanine that exhibits a main peak at a Bragg angle (2θ±0.2°) of 27.2° in a CuKα characteristic X-ray diffraction spectrum (also referred to below as a Y-form titanyl phthalocyanine crystal). The term a main peak refers to a most intense or second most intense peak within a range of Bragg angles (2θ±0.2°) from 3° to 40° in a CuKα characteristic X-ray diffraction spectrum. The Y-form titanyl phthalocyanine crystal may exhibit a peak at any Bragg angle other than at a Bragg angle (2θ±0.2°) of 27.2°.

The CuKα characteristic X-ray diffraction spectrum can be measured using an X-ray diffraction spectrometer (for example, RINT (registered Japanese trademark) 1100 produced by Rigaku Corporation). A main peak is determined from an obtained CuKα characteristic X-ray diffraction spectrum, and the Bragg angle of the main peak is read. A method for measuring a CuKα characteristic X-ray diffraction spectrum will be described later in detail.

The Y-form titanyl phthalocyanine crystal can be represented by for example chemical formula (CG-1) shown below.

(CG-1)

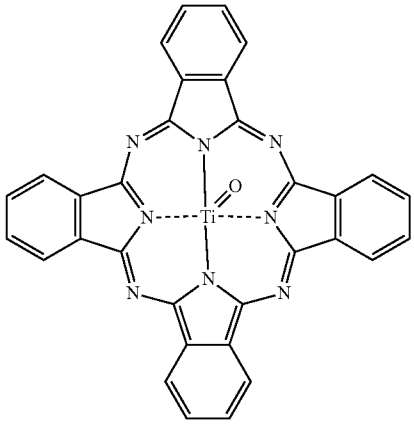

An example of the Y-form titanyl phthalocyanine crystal may exhibit, in a differential scanning calorimetry spectrum, one peak within a range of at least 270° C. and no greater than 400° C. and no peak in a range of at least 50° C. and no greater than 270° C. other than a peak resulting from vaporization of absorbed water. In a configuration in which Y-type titanyl phthalocyanine crystals such as above are used, transition in the crystal form of the Y-form titanyl phthalocyanine crystals from Y-form to α-form or α-form can be inhibited in an organic solution to improve charge generation efficiency.

The differential scanning calorimetry spectrum can be measured using a differential scanning calorimeter (for example, TAS-200 DSC 8230D produced by Rigaku Corporation). It can be confirmed from an obtained differential scanning calorimetry spectrum that one peak is present within a range from 270° C. to 400° C. other than a peak resulting from vaporization of absorbed water. A method for measuring a differential scanning calorimetry spectrum will be described later in detail.

Preferably, the charge generating material substantially contains only Y-form titanyl phthalocyanine crystals. However, the charge generating material may contain a material for formation of the photosensitive member 1 besides the Y-from titanyl phthalocyanine crystals. Examples of charge generating materials such as above include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, selenium, selenium-tellurium, selenium-arsenic, cadmium sulfide, powders of inorganic photoconductive materials such as amorphous silicon, pyrylium salts, anthanthrone-based pigments, triphenylmethane-based pigments, threne-based pigments, toluidine-based pigments, pyrazoline-based pigments, and quinacridon-based pigments. Examples of phthalocyanine-based pigments include phthalocyanine (specific examples include X-form metal-free phthalocyanine ($X—H_2PC$)) and phthalocyanine derivatives. Examples of phthalocyanine derivatives include titanyl phthalocyanine other than Y-form titanyl phthalocyanine (specific examples include α-form titanyl phthalocyanine and β-form titanyl phthalocyanine) and phthalocyanine including a ligand other than titanium oxide (specific examples include V-form hydroxygallium phthalocyanine). Any one of the materials listed above or a combination of any two or more of the materials listed above may be used as the charge generating material.

The content of the charge generating material is preferably at least 5 parts by mass and no greater than 1,000 parts by mass relative to 100 parts by mass of the base resin in the charge generating layer 3*a*, and more preferably at least 30 parts by mass and no greater than 500 parts by mass.

[2-1-2. Base Resin]

No particular limitation is placed on the base resin as long as it can be used in the photosensitive member 1. Examples of base resins that can be used include thermoplastic resins, thermosetting resins, and photocurable resins. Examples of thermoplastic resins that can be used include styrene-based resins, styrene-butadiene copolymers, styrene-acrylonitrile copolymers, styrene-maleaste copolymers, styrene-acryl acid-based copolymers, acrylic copolymers, polyethylene resins, ethylene-vinyl acetate copolymers, chlorinated polyethylene resins, polyvinyl chloride resins, polypropylene resins, ionomer, vinyl chloride-vinyl acetate copolymers, alkyd resins, polyamide resins, urethane resins, polycarbonate resins, polyarylate resins, polysulfone resins, diallyl phthalate resins, ketone resins, polyvinyl butyral resins, polyether resins, and polyester resins. Examples of thermosetting resin that can be used include silicone resins, epoxy resins, phenolic resins, urea resins, melamine resins, and any other crosslinkable thermosetting resins. Examples of photocurable resins that can be used include epoxy acrylic acid-based resins and urethane-acrylic acid-based resins. Any one of the materials listed above or a combination of any two or more of the materials listed above may be used as the base resin.

Although many of the same examples are given for the base resin and the binder resin, a base resin and a binder resin included in the same photosensitive member 1 are typically selected so as to be different from one another. The following describes the reason thereof. In a situation in which the photosensitive member 1 is produced, typically, the charge generating layer 3*a* is formed first and the charge transport layer 3*b* is then formed. Specifically, an application liquid for charge transport layer formation is applied onto the charge generating layer 3*a*. As such, the charge generating layer 3*a* is required to be insoluble in a solvent of the application liquid for charge transport layer formation in formation of the charge transport layer 3*b*. In view of the foregoing, a base resin and a binder resin included in the same photosensitive member 1 are selected so as to be different from one another.

[2-2. Charge Transport Layer]

The charge transport layer 3*b* contains the hole transport material and the binder resin. The charge transport layer 3*b* may contain an additive depending on necessity. No particular limitation is placed on the thickness of the charge transport layer 3*b* as long as the charge transport layer can work satisfactorily. Specifically, the thickness of the charge transport layer 3*b* is preferably at least 2 μm and no greater than 100 μm, and more preferably at least 5 μm and no greater than 50 μm. The charge transport layer 3*b* may further contain an electron acceptor compound. Following describes the hole transport material, the binder resin, and the electron acceptor compound.

[2-2-1. Hole Transport Material]

The hole transport material contains the triarylamine derivative (1). The triarylamine derivative (1) is represented by general formula (1) shown below.

(1)

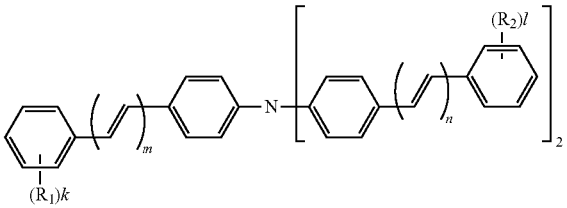

In general formula (1), $R_1$ and $R_2$ each represent, independently of one another, a halogen atom, an optionally substituted alkyl group having a carbon number of at least 1 and no greater than 6, an optionally substituted alkoxy group having a carbon number of at least 1 and no greater than 6, or an optionally substituted aryl group having a carbon number of at least 6 and no greater than 12. Further, k and l represents, independently of one another, an integer of at least 0 and no greater than 4. When k and l represent integers greater than 1, chemical groups $R_1$ bonded to the same aromatic ring may be the same or different from one another. When l represents an integer greater than 1, chemical groups $R_2$ bonded to the same aromatic ring may be the same or different from one another. Further, m and n each represent, independently of one another, an integer of at least 1 and no greater than 3 and represent integers different from one another.

In general formula (1), the alkyl group having a carbon number of at least 1 and no greater than 6 represented by $R_1$ or $R_2$ is preferably an alkyl group having a carbon number of at least 1 and no greater than 3, and more preferably a methyl group. An alkyl group such as above may have one or more substituents. Examples of substituents that the alkyl group may have include a halogen atom, a hydroxyl group, an alkoxy group having a carbon number of at least 1 and no greater than 4, and a cyano group.

In general formula (1), the alkoxy group having a carbon number of at least 1 and no greater than 6 represented by $R_1$ or $R_2$ is preferably an alkoxy group having a carbon number of at least 1 and no greater than 3, and more preferably a methoxy group. An alkoxy group such as above may have one or more substituents. Examples of substituents that the alkoxy group may have include a halogen atom, a hydroxyl group, an alkoxy group having a carbon number of at least 1 and no greater than 4, and a cyano group.

In general formula (1), the aryl group having a carbon number of at least 6 and no greater than 12 represented by $R_1$ or $R_2$ is preferably a phenyl group. An aryl group such as above may have one or more substituents. Examples of substituents that the aryl group may have include a halogen atom, a hydroxyl group, an alkyl group having a carbon number of at least 1 and no greater than 4, an alkoxy group having a carbon number of at least 1 and no greater than 4, a nitro group, and a cyano group.

In general formula (1), $R_1$ preferably represents an alkyl group having a carbon number of at least 1 and no greater than 3 or an alkoxy group having a carbon number of at least 1 and no greater than 3, and more preferably a methyl group or a methoxy group. Further, $R_2$ preferably represents an alkyl group having a carbon number of at least 1 and no greater than 3, and more preferably a methyl group.

In general formula (1), preferably, k and l each represent, independently of one another, an integer of at least 0 and no greater than 4, and more preferably represents, independently of one another, 0 or 1. When k represents an integer greater than 1, chemical groups $R_1$ bonded to the same aromatic ring (benzene ring) may be the same or different from one another. In order to facilitate understanding, an example is given in which k represents 2 and in which two chemical groups $R_1$ bonded to the same aromatic ring (phenyl group) are bonded to the phenyl group at an ortho position and a meta position. In such a configuration, the ortho position $R_1$ and the meta position $R_1$ bonded to the same aromatic ring may be the same or different from one another. However, in the above configuration, the ortho position $R_1$ is the same for each of the two aromatic rings in which $R_1$ is present. Also, in the above configuration, the meta position $R_1$ is the same for each of the two aromatic rings in which $R_1$ is present.

When l represents an integer greater than 1, chemical groups $R_2$ bonded to the same aromatic ring (benzene ring) may be the same or different from one another. In order to facilitate understanding, an example is given in which l represents 2 and in which two chemical groups $R_2$ bonded to the same aromatic ring (phenyl group) are bonded to the phenyl group at an ortho position and a meta position. In such a configuration, the ortho position $R_2$ and the meta position $R_2$ bonded to the same aromatic ring may be the same or different from one another. However, in the above configuration, the ortho position $R_2$ is the same for each of the two aromatic rings in which $R_2$ is present. Also, in the above configuration, the meta position $R_2$ is the same for each of the two aromatic rings in which $R_2$ is present.

The triarylamine derivative (1) has an asymmetric structure. The triarylamine derivative (1) having such an asymmetric structure can be obtained by m and n being different from one another in general formula (1). Furthermore, the triarylamine derivative (1) having such an asymmetric structure may be obtained under an additional condition. Examples of the additional condition include a type of a substituent (more specifically, $R_1$ or $R_2$), a position of a substituent bonded to a benzene ring, and the number of substituents to be substituted.

Specific compounds of the triarylamine derivative (1) are represented by chemical formulas (HTM-1)-(HTM-10) shown below.

(HTM-1)

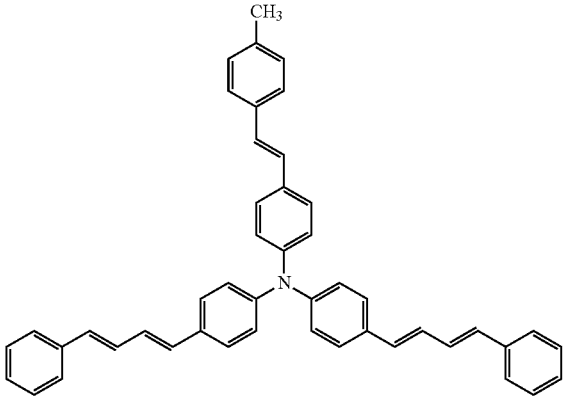

(HTM-2)

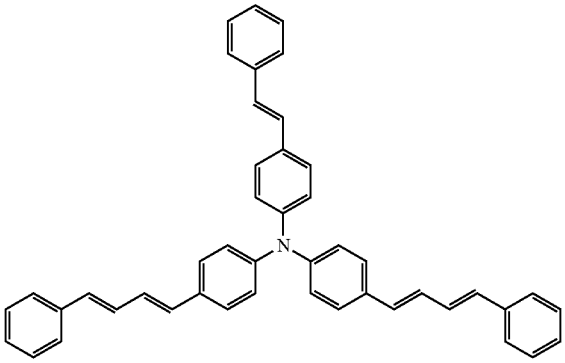

(HTM-3)

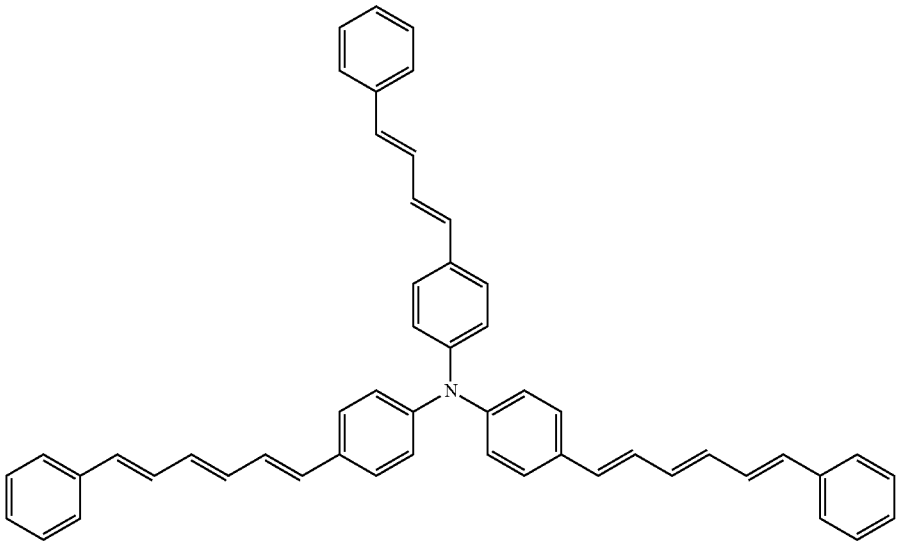

-continued
(HTM-4)
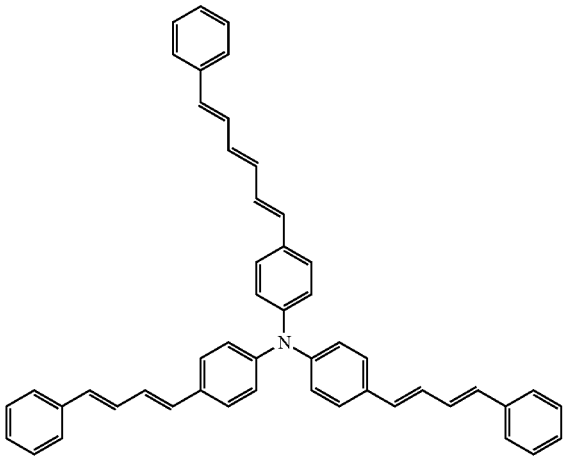
(HTM-5)
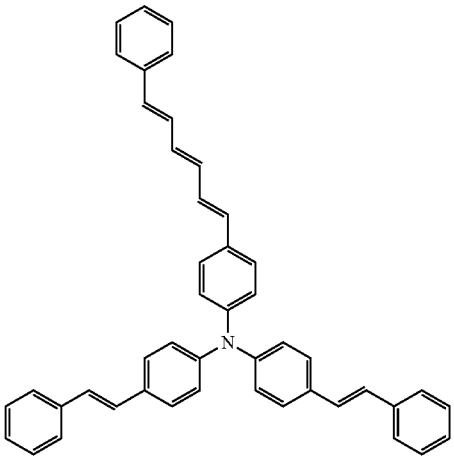
(HTM-6)
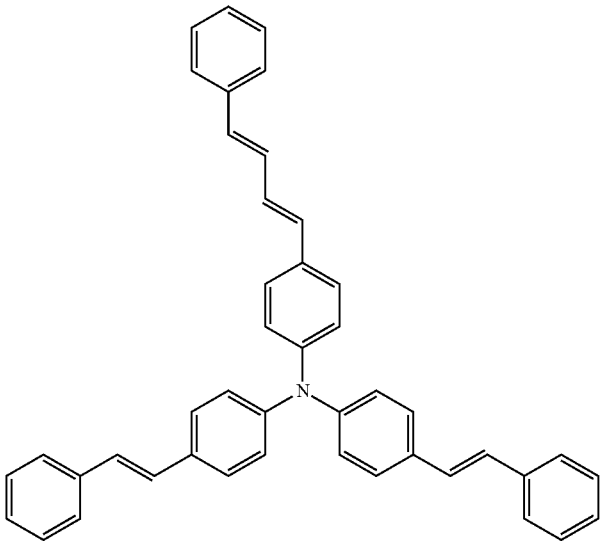
(HTM-7)
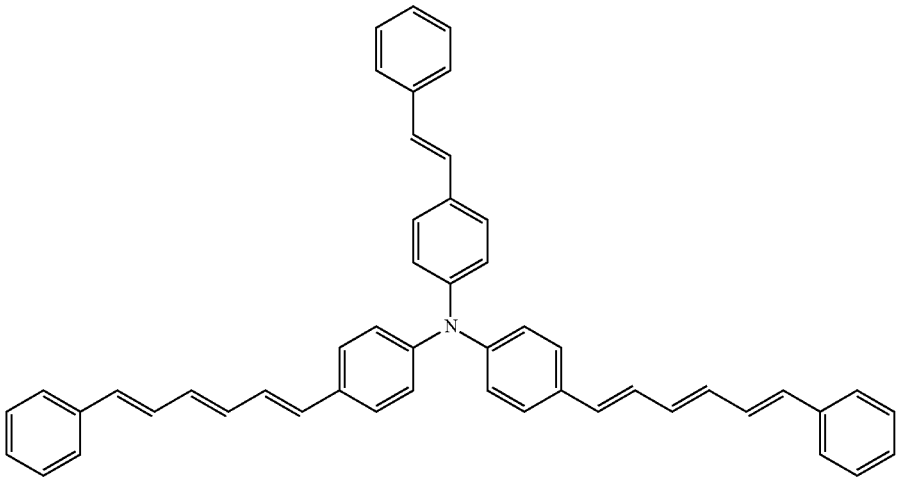

-continued
(HTM-8)
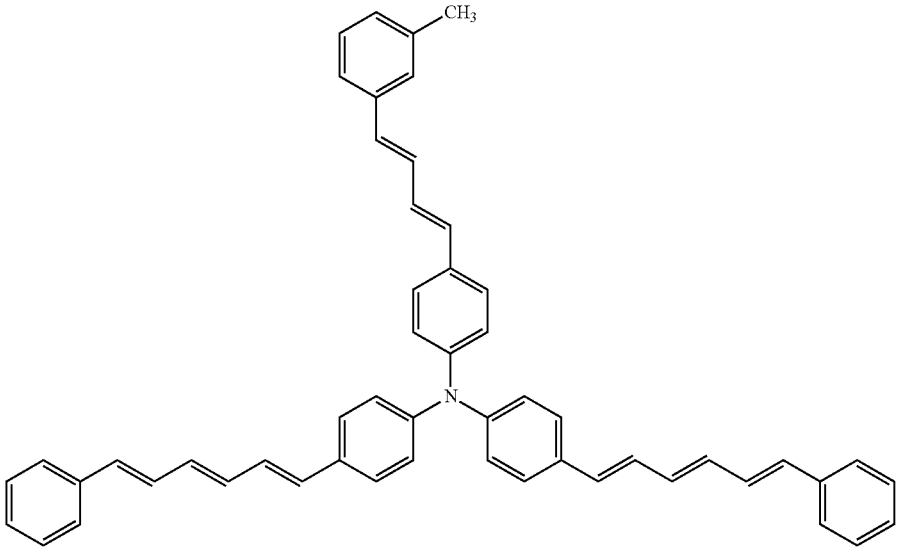
(HTM-9)
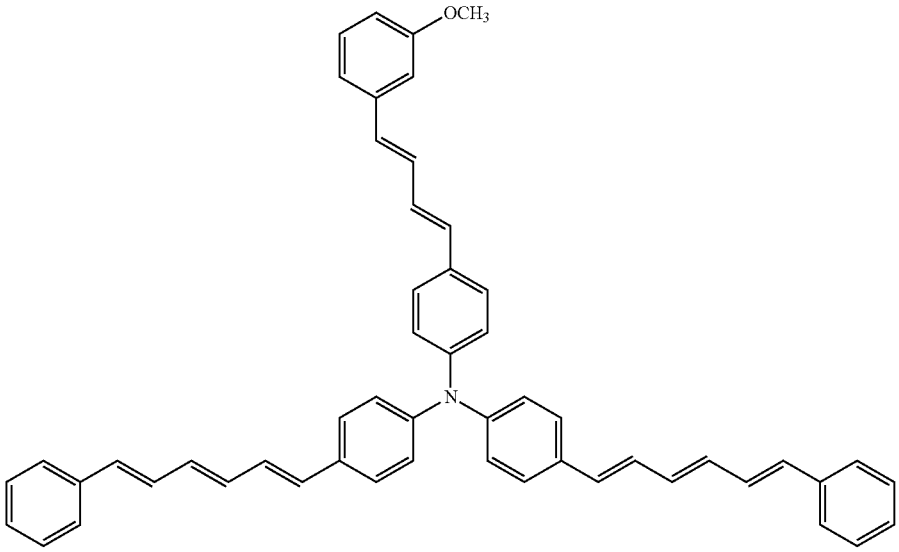

-continued (HTM-10)

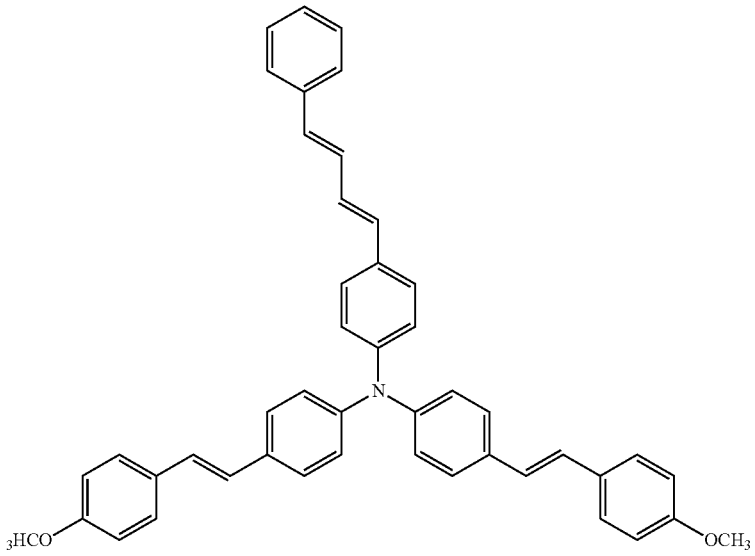

Figure 2:
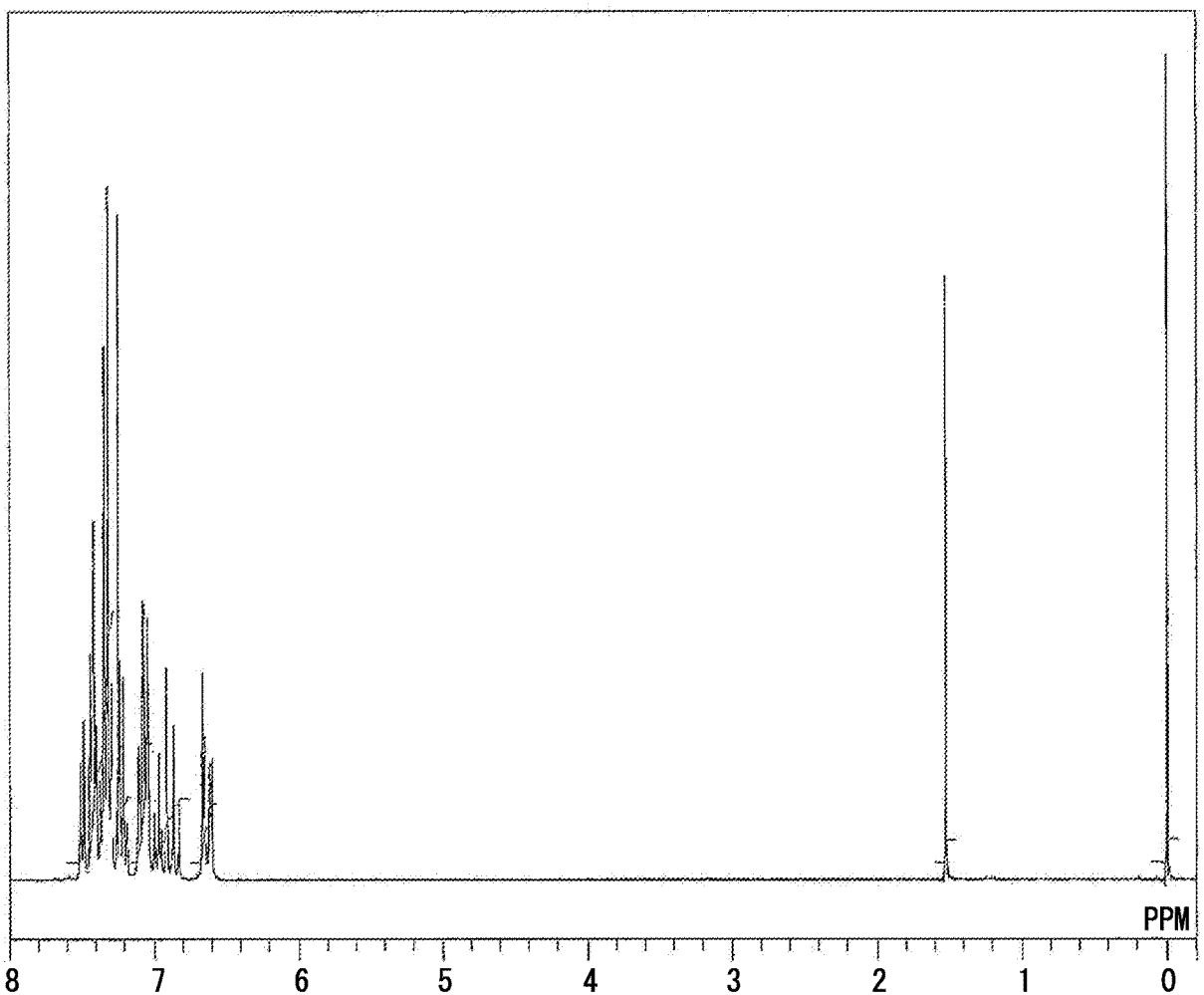
FIG. 2 is a $^1$H-NMR spectrum of a triarylamine derivative represented by chemical formula (HTM-1).

FIG. 2 illustrates a $^1$H-NMR spectrum of the triarylamine derivative represented by chemical formula (HTM-1).

The triarylamine derivative (1) can be produced according to Reactions (R-1)-(R-7) shown below, or through a method conforming therewith. An appropriate process may be involved depending on necessity in addition to the reactions represented by reaction formulas (R-1)-(R-7) (also referred to below as Reactions (R-1)-(R-7), respectively). Reactions (R-1)-(R-7) will be described in detail below.

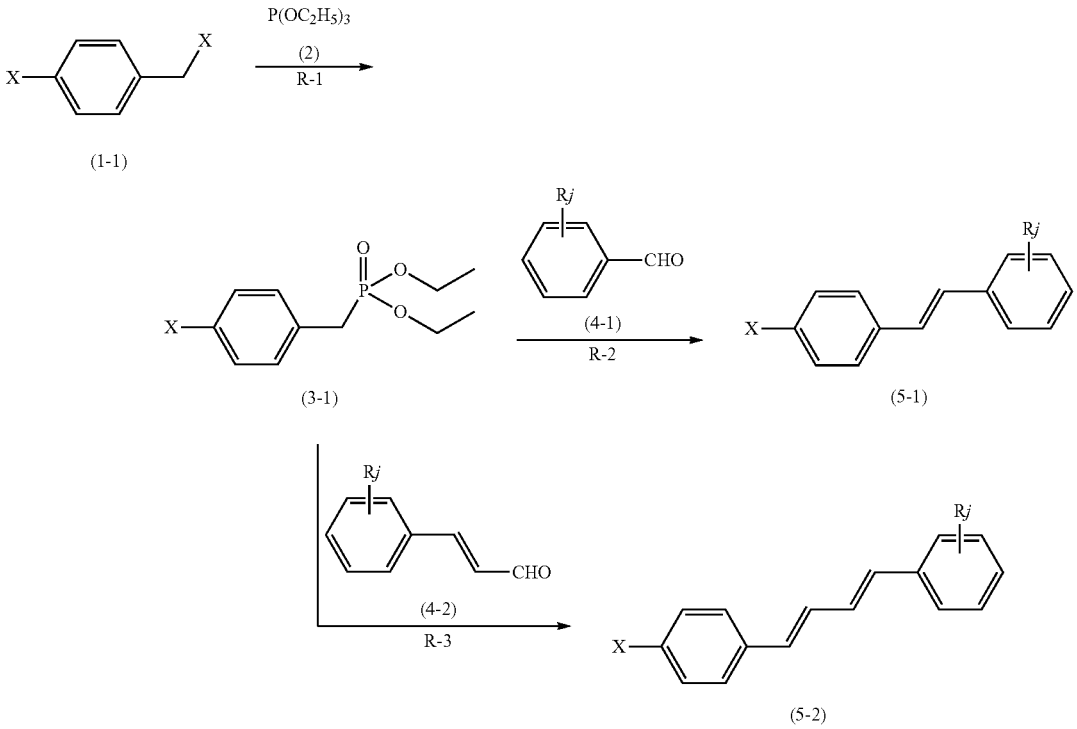

-continued

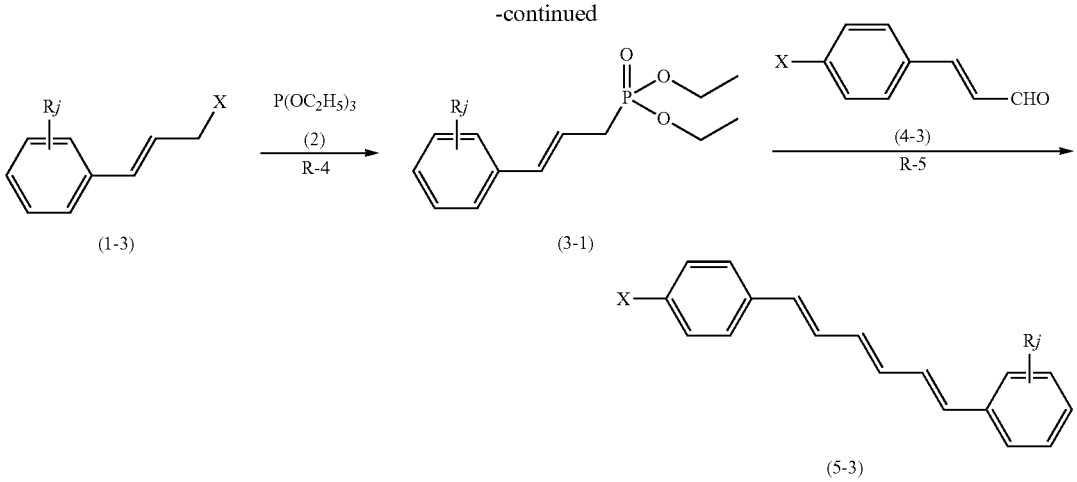

In Reactions (R-1)-(R-5), R is the same as defined for $R_1$ or $R_2$ in general formula (1). Further, j is the same as defined for k or l in general formula (1). A halogen atom is represented by X.

[Reaction (R-1)]

In Reaction (R-1), a benzene derivative (1-1) is caused to react with triethyl phosphite that is a compound (2) to yield a phosphonate derivative (3-1).

A reaction ratio between the benzene derivative (1-1) and triethyl phosphite that is the compound (2) [benzene derivative (1-1): triethyl phosphite] is preferably a molar ratio of 1:1 to 1:2.5. In a configuration in which the number of moles of triethyl phosphite relative to 1 mole of the benzene derivative (1-1) is at least 1 mole and no greater than 2.5 moles, the percentage yield of the phosphonate derivative (3-1) may not decrease, thereby facilitating purification of the phosphonate derivative (3-1).

The reaction of the benzene derivative (1-1) with triethyl phosphite is preferably carried out at a reaction temperature of at least 160° C. and no greater than 200° C. and with a reaction time of at least 2 hours and no greater than 10 hours.

[Reaction (R-2)]

In Reaction (R-2), the phosphonate derivative (3-1) is caused to react with a benzaldehyde derivative (4-1) to yield a diphenylethene derivative (5-1) (also referred to below as a Wittig reaction in Reaction (R-2)).

The reaction ratio between the phosphonate derivative (3-1) and the benzaldehyde derivative (4-1) [phosphonate derivative (3-1): benzaldehyde derivative (4-1)] is preferably a molar ratio of 1:1 to 1:2.5. In a configuration in which the number of moles of the benzaldehyde derivative (4-1) relative to 1 mole of the phosphonate derivative (3-1) is at least 1 mole and no greater than 2.5 moles, the percentage yield of the diphenylethene derivative (5-1) may not decrease, thereby facilitating purification of the diphenylethene derivative (5-1).

The Wittig reaction (Reaction (R-2)) can be carried out in the presence of a catalyst. Examples of catalysts that can be used include sodium alkoxides (specifically, sodium methoxide or sodium ethoxide), metal hydrides (specifically, sodium hydride or potassium hydride), and metal salts (specifically, n-butyl lithium). Any one of the catalysts listed above may be used, or a combination of any two or more of the catalysts listed above may be used.

The additive amount of such a catalyst is preferably at least 1 mole and no greater than 2 moles relative to 1 mole of the benzaldehyde derivative (4-1). In a configuration in which the additive amount of the catalyst is within the above range, reactivity may not decrease and the reaction can be easily controlled.

Reaction (R-2) can be carried out in a solvent. Examples of solvents that can be used include ethers (specific examples include tetrahydrofuran, diethyl ether, and dioxane), halogenated hydrocarbons (specific examples include methylene chloride, chloroform, and dichloroethane), and aromatic hydrocarbons (specific examples include benzene and toluene).

The reaction of the phosphonate derivative (3-1) with the benzaldehyde derivative (4-1) is preferably carried out at a reaction temperature of at least 0° C. and no greater than 50° C. and with a reaction time of at least 2 hours and no greater than 24 hours.

[Reaction (R-3)]

In Reaction (R-3), the phosphonate derivative (3-1) is caused to react with a cinnamaldehyde derivative (4-2) to yield a diphenylbutadiene derivative (5-2) (also referred to below as a Wittig reaction in Reaction (R-3)).

The reaction ratio between the phosphonate derivative (3-1) and the cinnamaldehyde derivative (4-2) [phosphonate derivative (3-1): cinnamaldehyde derivative (4-2)] is preferably a molar ratio of 1:1 to 1:2.5. In a configuration in which the number of moles of the cinnamaldehyde derivative (4-2) relative to 1 mole of the phosphonate derivative (3-1) is at least 1 mole and no greater than 2.5 moles, the percentage yield of the diphenylbutadiene derivative (5-2) may not decrease, thereby facilitating purification of the diphenylbutadiene derivative (5-2).

The Wittig reaction (Reaction (R-3)) can be carried out in the presence of a catalyst. Examples of catalysts that can be used include those listed as examples of catalysts that can be used in Reaction (R-2). Any one of the catalysts listed above may be used or a combination of any two or more of the catalysts listed above may be used.

The additive amount of such a catalyst is preferably at least 1 mole and no greater than 2 moles relative to 1 mole of the cinnamaldehyde derivative (4-2). In a configuration in which the additive amount of the catalyst is within the above range, reactivity may not decrease and the reaction can be easily controlled.

Reaction (R-3) can be carried out in a solvent. Examples of solvents that can be used include those listed as examples of solvents that can be used in Reaction (R-2).

The reaction of the phosphonate derivative (3-1) with the cinnamaldehyde derivative (4-2) is preferably carried out at a reaction temperature of at least 0° C. and no greater than 50° C. and with a reaction time of at least 2 hours and no greater than 24 hours.

[Reaction (R-4)]

In Reaction (R-4), a benzene derivative (1-3) is caused to react with triethyl phosphite that is the compound (2) to yield a phosphonate derivative (3-3).

The reaction ratio between the benzene derivative (1-3) and triethyl phosphite that is the compound (2) [benzene derivative (1-3): triethyl phosphite] is preferably a molar ratio of 1:1 to 1:2.5. In a configuration in which the number of moles of triethyl phosphite relative to 1 mole of the benzene derivative (1-3) is at least 1 mole and no greater than 2.5 moles, the percentage yield of the phosphonate derivative (3-3) may not decrease, thereby facilitating purification of the phosphonate derivative (3-3).

The reaction of the benzene derivative (1-3) with triethyl phosphite is preferably carried out at a reaction temperature of at least 160° C. and no greater than 200° C. and with a reaction time of at least 2 hours and no greater than 10 hours.

[Reaction (R-5)]

In Reaction (R-5), the phosphonate derivative (3-3) is caused to react with a cinnamaldehyde derivative (4-3) to yield a diphenylhexatriene derivative (5-3) (also referred to below as a Wittig reaction in Reaction (R-5)).

The reaction ratio between the phosphonate derivative (3-3) and the cinnamaldehyde derivative (4-3) [phosphonate derivative (3-3): cinnamaldehyde derivative (4-3)] is preferably a molar ratio of 1:1 to 1:2.5. In a configuration in which the number of moles of the cinnamaldehyde derivative (4-3) relative to 1 mole of the phosphonate derivative (3-3) is at least 1 mole and no greater than 2.5 moles, the percentage yield of the diphenylhexatriene derivative (5-3) may not decrease, thereby facilitating purification of the diphenylhexatriene derivative (5-3).

The Wittig reaction (Reaction (R-5)) can be carried out in the presence of a catalyst. Examples of catalysts that can be used include those listed as examples of catalysts that can be used in Reaction (R-2). Any one of the catalysts listed above may be used or a combination of any two or more of the catalysts listed above may be used.

The additive amount of such a catalyst is preferably at least 1 mole and no greater than 2 moles relative to I mole of the cinnamaldehyde derivative (4-3). In a configuration in which the additive amount of the catalyst is within the above range, reactivity may not decrease and the reaction can be easily controlled.

Reaction (R-5) can be carried out in a solvent. Examples of solvents that can be used include those listed as examples of solvents that can be used in Reaction (R-2).

The reaction of the phosphonate derivative (3-3) with the cinnamaldehyde derivative (4-3) is preferably carried out at a reaction temperature of at least 0° C. and no greater than 50° C. and with a reaction time of at least 2 hours and no greater than 24 hours.

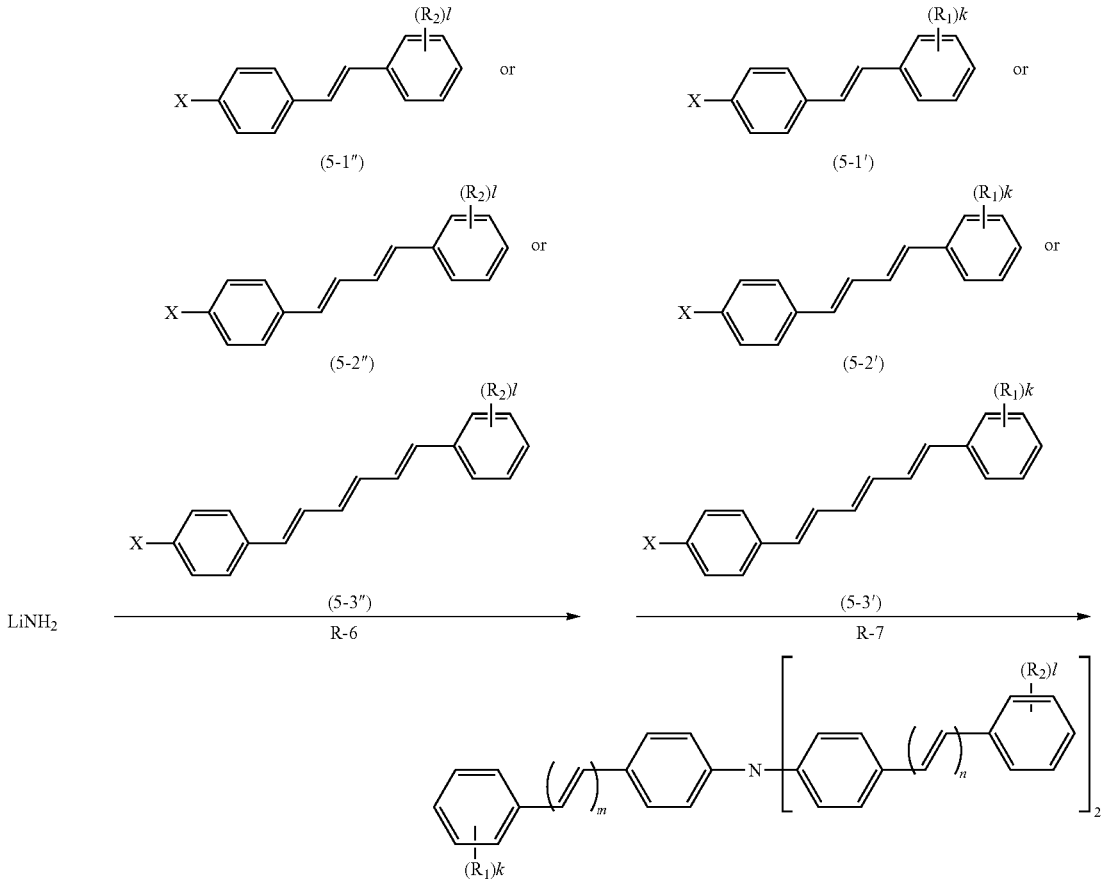

(1)

In Reactions (R-6) and (R-7), $R_1$, $R_2$, k, l, m, and n are the same as defined for $R_1$, $R_2$, k, l, m, and n in general formula (1), respectively. A halogen atom is represented by X.

[Reaction (R-6)]

In Reaction (R-6), lithium amide is caused to react with a diphenylethene derivative (5-1"), a diphenylbutadiene derivative (5-2"), or a diphenylhexatriene derivative (5-3") to yield an intermediate compound (a coupling reaction). The diphenylethene derivative (5-1") is a diphenylethene derivative (5-1) as a result of Reaction (R-2) in which R and j are the same as defined for $R_2$ and l in general formula (1), respectively. The diphenylbutadiene derivative (5-2") is a diphenylbutadiene derivative (5-2) as a result of Reaction (R-3) in which R and j are the same as defined for $R_2$ and l in general formula (1), respectively. The diphenylhexatriene derivative (5-3") is a diphenylbutadiene derivative (5-3) as a result of Reaction (R-5) in which R and j are the same as defined for $R_2$ and l in general formula (1), respectively.

The reaction ratio between lithium amide and the diphenylethene derivative (5-1"), diphenylbutadiene derivative (5-2"), or diphenylhexatriene derivative (5-3") [lithium amide: derivative (5-1"), (5-2"), or (5-3")] is preferably a molar ratio of 1:1 to 1:5.

In a configuration in which the number of moles of the derivative (5-1"), (5-2"), or (5-3") relative to 1 mole of lithium amide is at least 1 and no greater than 5, the percentage yield of the intermediate compound may not decrease, thereby facilitating purification of the intermediate compound.

Reaction (R-6) is preferably carried out at a reaction temperature of at least 80° C. and no greater than 140° C. and with a reaction time of at least 2 hours and no greater than 10 hours.

Preferably, a palladium compound is used as a catalyst in Reaction (R-6). The use of a palladium compound can reduce activation energy in Reaction (R-6). As a result, the percentage yield of the intermediate compound can be further increased.

Examples of palladium compounds that can be used include tetravalent palladium compounds, divalent palladium compounds, and other palladium compounds. Examples of tetravalent palladium compounds that can be used include hexachloro palladium(IV) sodium tetrahydrate and hexachloro palladium(IV) potassium tetrahydrate. Examples of divalent palladium compounds that can be used include palladium(II) chloride, palladium(II) bromide, palladium(II) acetate, palladium(II) acetylacetate, dichlorobis(benzonitrile)palladium(II), dichlorobis(triphenylphosphine)palladium(II), dichlorotetraminepalladium(II), and dichloro(cycloocta-1,5-diene)palladium (II). Examples of the other palladium compounds that can be used include tris(dibenzylideneacetone)dipalladium(0), tris(dibenzylideneacetone)dipalladium chloroform complex(0), and tetrakis(triphenylphosphine)palladium(0). Any one of the palladium compounds listed above may be used or a combination of any two or more of the palladium compounds listed above may be used.

The additive amount of the palladium compound is preferably at least 0.0005 moles and no greater than 20 moles relative to the derivative (5-1"), (5-2"), or (5-3"), and more preferably at least 0.001 moles and no greater than 1 mole.

A palladium compound such as above may have a structure including a ligand. A palladium compound having a structure including a ligand can improve reactivity of Reaction (R-6). Examples of ligands that the palladium compound may have include tricyclohexylphosphine, triphenylphosphine, methyldiphenylphosphine, trifurylphosphine, tri(o-tolyl)phosphine, dicyclohexylphenylphosphine, tri(tert-butyl)phosphine, 2,2'-bis(diphenylphosphino)-1,1'-binaphthyl, and 2,2'-bis[(diphenylphosphino)diphenyl]ether. Any one of the ligands listed above may be used or a combination of any two or more of the ligands listed above may be used. The additive amount of the ligand is preferably at least 0.0005 moles and no greater than 20 moles relative to 1 part by mass of the derivative (5-1"), (5-2"), or (5-3"), and more preferably at least 0.001 moles and no greater than 1 mole.

Reaction (R-6) is preferably carried out in the presence of a base. Reaction (R-6) in the presence of a base can promote neutralization of halogenated hydrogen generated during the reaction to improve activation of the catalyst. As a result, the percentage yield of the intermediate compound can be increased.

The base may be an inorganic base or an organic base. Examples of preferable organic bases that can be used include alkali metal alkoxide (specific examples include sodium methoxide, sodium ethoxide, potassium methoxide, potassium ethoxide, lithium tert-butoxide, sodium tert-butoxide, and potassium tert-butoxide) with sodium tert-butoxide being more preferable. Examples of inorganic bases that can be used include tripotassium phosphate and caesium fluoride.

In a configuration in which at least 0.0005 moles and no greater than 20 moles of a palladium compound is added relative to I mole of the derivative (5-1"), (5-2"), or (5-3"), the additive amount of the base is preferably at least 1 mole and no greater than 50 moles, and more preferably at least 1 mole and no greater than 30 moles.

Reaction (R-6) can be carried out in a solvent. Examples of solvents that can be used include xylene (specific examples include o-xylene), toluene, tetrahydrofuran, and dimethyl formamide.

[Reaction (R-7)]

In Reaction (R-7), the resultant intermediate compound is caused to react with a diphenylethene derivative (5-1'), a diphehylbutadiene derivative (5-2'), or a diphenylhexatriene derivative (5-3') to yield a triarylamine derivative (1) that is a target compound (coupling reaction). In the diphenylethene derivative (5-1'), $R_1$ and k are the same as defined for R and j in the diphenylethene derivative (5-1) as a result of Reaction (R-2), respectively. In the diphenylbutadiene derivative (5-2'), $R_1$ and k are the same as defined for R and j in the diphenylethene derivative (5-2) as a result of Reaction (R-3), respectively. In the diphenylhexatriene derivative (5-3'), $R_1$ and k are the same as defined for R and j in the diphenylethene derivative (5-3) as a result of Reaction (R-5), respectively.

The reaction ratio between the intermediate compound and the diphenylethene derivative (5-1'), the diphenylbutadiene derivative (5-2'), or the diphenylhexatriene derivative (5-3') [intermediate compound: derivative (5-1'), (5-2'), or (5-3')] is preferably a molar ratio of 1:1 to 5:1.

In a configuration in which the molar ratio of the intermediate compound relative to the derivative (5-1'), (5-2'), or (5-3') is too small, the percentage yield of the triarylamine derivative (1) may decrease excessively. By contrast, in a configuration in which the molar ratio of the intermediate compound relative to the derivative (5-1'), (5-2'), or (5-3') is too large, an excessive amount of unreacted intermediate compound may remain after the reaction to make it difficult to purify the triarylamine derivative (1).

Reaction (R-7) is preferably carried out at a reaction temperature of at least 80° C. and no greater than 140° C. and with a reaction time of at least 2 hours and no greater than 10 hours.

Preferably, a palladium compound is used as a catalyst in Reaction (R-7). The use of a palladium compound can reduce activation energy in Reaction (R-7). As a result, the percentage yield of the triarylamine derivative (1) can be further increased.

Examples of palladium compounds that can be used include those listed as examples of palladium compounds that can be used in Reaction (R-6). Any one of the palladium compounds listed above may be used or a combination of any two or more of the palladium compounds listed above may be used.

The additive amount of the palladium compound is preferably at least 0.0005 moles and no greater than 20 moles relative to 1 mole of the derivative (5-1'), (5-2'), or (5-3'), and more preferably at least 0.001 moles and no greater than 1 mole.

A palladium compound such as described above may have a structure including a ligand. A palladium compound having a structure including a ligand can improve reactivity of Reaction (R-7). Examples of ligands that the palladium compound may have include those listed as examples of ligands that can be used in Reaction (R-6). Any one of the ligands listed above may be used or a combination of any two or more of the ligands listed above may be used. The additive amount of the ligand is preferably at least 0.0005 moles and no greater than 20 moles relative to 1 mole of the derivative (5-1'), (5-2'), or (5-3'), and more preferably at least 0.001 moles and no greater than 1 mole.

Reaction (R-7) is preferably carried out in the presence of a base. Reaction (R-7) in the presence of a base can promote neutralization of halogenated hydrogen generated during the reaction to improve activation of the catalyst. As a result, the percentage yield of the triarylamine derivative (1) can be increased.

The base that can be used may be an inorganic base or an organic base. Examples of organic bases and inorganic bases that can be used include those listed as examples of organic bases and inorganic bases that can be used in Reaction (R-6).

In a configuration in which at least 0.0005 moles and no greater than 20 moles of a palladium compound is added relative to 1 mole of the derivative (5-1'), (5-2'), or (5-3'), the additive amount of the base is preferably at least 1 mole and no greater than 10 moles, and more preferably at least 1 mole and no greater than 5 moles.

Reaction (R-7) can be carried out in a solvent. Examples of solvents that can be used include those listed as examples of solvents that can be used in Reaction (R-6).

The hole transport material may optionally contain a hole transport material other than the above triarylamine derivative. Examples of hole transport materials that can be optionally contained include nitrogen containing cyclic compounds and condensed polycyclic compounds. Examples of nitrogen containing cyclic compounds and condensed polycyclic compounds include: diamine derivatives (specific examples include an N,N,N',N'-tetraphenylbenzidine derivative, an tetraphenylphenylenediamine, an N,N,N',N'-tetraphenylnaphtylenediamine derivative, an N,N,N',N'-tetraphenylphenanthrylenediamine derivative, and a di(aminophenylethenyl)benzene derivative); oxadiazole-based compounds (specific examples include 2,2,5-di(4-methylaminophenyl)-1,3,4-oxadiazole); styryl-based compounds (specific examples include 9-(4-diethylaminostyryl) anthracene); carbazole-based compounds (specific examples include polyvinyl carbazole); organic polysilane compounds; pyrazoline-based compound (specific examples include 1-phenyl-3-(p-dimethylaminophenyl)pyrazoline); hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds.

In the charge transport layer, the total mass ratio of the hole transport materials is at least 0.30 and no greater than 0.55 relative to a mass of the binder resin.

The content of the charge transport material is preferably at least 5 parts by mass and no greater than 1,000 parts by mass relative to 100 parts by mass of the binder resin in the charge transport layer 3*b*, and more preferably at least 30 parts by mass and no greater than 500 parts by mass.

[2-2-2. Binder Resin]

The binder resin preferably contains a polycarbonate resin represented by general formula (2) (also referred to below as a polycarbonate resin (2)).

(2)

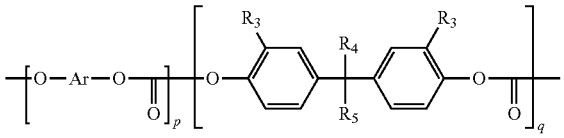

In general formula (2), Ar represents a divalent base represented by any of general formulas (2-1), (2-2), and (2-3) and chemical formula (2-4). Further, $R_3$, $R_4$, and $R_5$ represent, independently of one another, a hydrogen atom, an alkyl group, or aryl group. However, $R_4$ and $R_5$ may optionally be bonded to one another to form a ring of a cycloalkylidene group. Yet, $p+q=1.00$ and $0.35 \leq q < 0.70$.

(2-1)

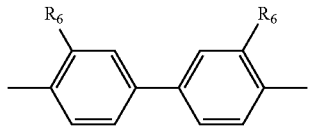

(2-2)

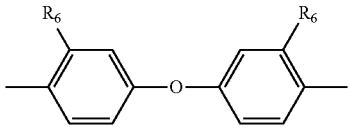

(2-3)

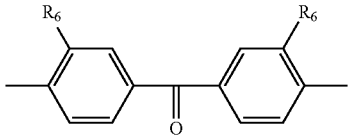

(2-4)

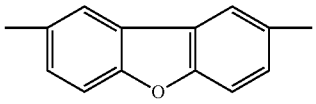

In general formulas (2-1), (2-2), and (2-3), $R_6$ represents a hydrogen atom, an alkyl group, or an aryl group.

Examples of alkyl groups that can be represented by $R_3$-$R_6$ in general formula (2) include alkyl groups having a carbon number of at least 1 and no greater than 6 with an alkyl group having a carbon number of at least 1 and no greater than 3 being preferable and a methyl group or ethyl group being more preferable. Examples of aryl group that can be represented by $R_3$-$R_6$ in general formula (2) include aryl groups having a carbon number of at least 6 and no greater than 12. In general formula (2), $R_4$ and $R_5$ may optionally be bonded to one another to form a ring of a cycloalkylidene group. Examples of cycloalkylidene groups include cycloalkylidene groups having a carbon number of at least 5 and no greater than 7 with a cyclohexylidene group being preferable.

Preferably, $R_3$ in general formula (2) and $R_6$ in general formulas (2-1)-2-3) each represents a hydrogen atom. Preferably, $R_4$ and $R_5$ each represent an alkyl group having a carbon number of at least 1 and no greater than 3 (specific examples include a methyl group and an ethyl group) or are bonded to one another to form a ring of a cycloalkylidene group (specific examples include a cyclohexylidene group and a cyclopentylidene group).

The polycarbonate resin (2) has a repeating unit represented by general formula (4) (also referred to below as a repeating unit (4)) and a repeating unit represented by general formula (5) (also referred to below as a repeating unit (5)).

(4)

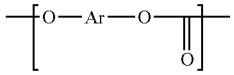

(5)

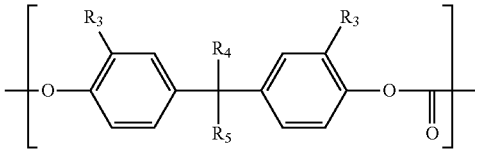

Ar in general formula (4) and $R_3$-$R_5$ in general formula (5) are the same as defined for Ar and $R_3$-$R_5$ in general formula (2), respectively.

In general formula (2), p and q satisfy p+q=1.00 and $0.35 \leq q < 0.70$. Further, p represents a molar ratio of the number of moles of the repeating unit (4) relative to a sum of the number of moles of the repeating units (4) and the number of moles of the repeating unit (5) in the polycarbonate resin (2). Yet, q represents a molar ratio of the number of moles of the repeating unit (5) relative to a sum of the number of moles of the repeating units (4) and the number of moles of the repeating unit (5) in the polycarbonate resin (2). In a configuration in which q is at least 0.35 and less than 0.70, mechanical strength of the photosensitive member 1 can be improved, resulting in the photosensitive member 1 having excellent abrasion resistance.

No particular limitation is placed on location of the repeating units (4) and (5) in the polycarbonate resin (2). Examples of the polycarbonate resin (2) include random copolymers, alternating copolymers, periodic copolymers, and block copolymers. Examples of random copolymers of the polycarbonate resin (2) include copolymers in which the repeating units (4) and (5) are arranged at random. Examples of alternating copolymers of the polycarbonate resin (2) include copolymers in which the repeating units (4) and (5) are arranged in an alternate manner. Examples of periodic copolymers of the polycarbonate resin (2) include one or more repeating units (4) and one or more repeating units (5) are arranged in a periodic manner. Examples of block copolymers of the polycarbonate resin (2) include copolymers in which a block of a plurality of repeating units (4) and a block of a plurality of repeating units (5) are arranged. Specific compounds (polycarbonate resins (Resin-1)-(Resin-10) of the polycarbonate resin (2) are shown below.

(Resin-1)

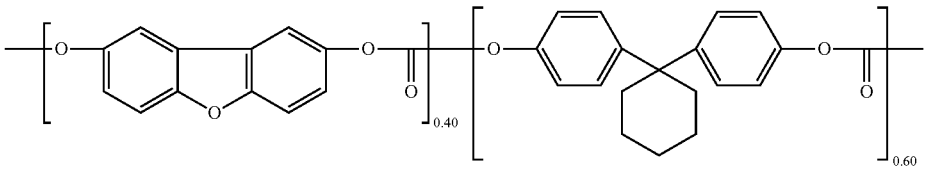

(Resin-2)

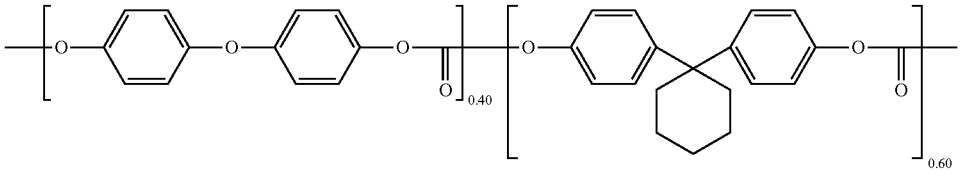

(Resin-3)

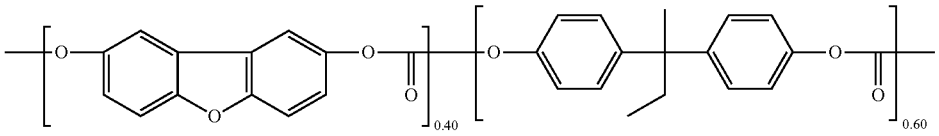

-continued (Resin-4)

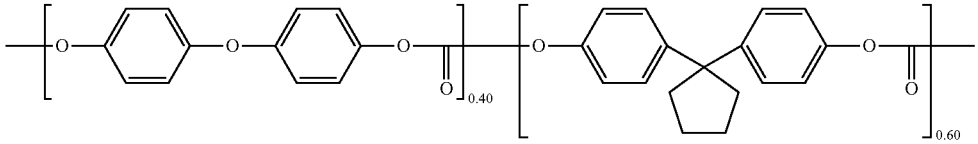

(Resin-5)

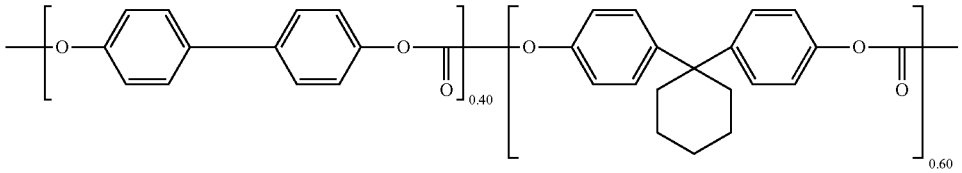

(Resin-6)

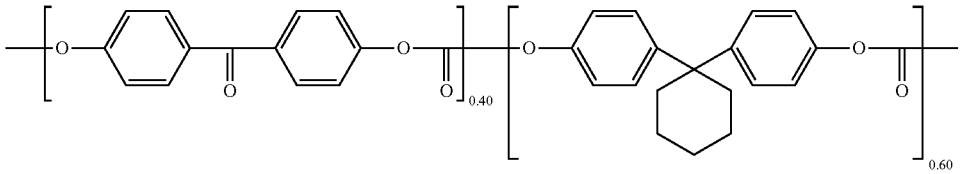

(Resin-7)

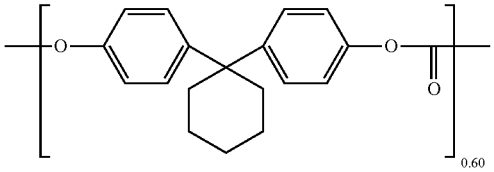

(Resin-8)

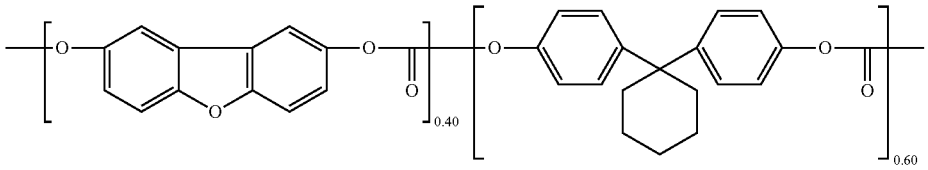

(Resin-9)

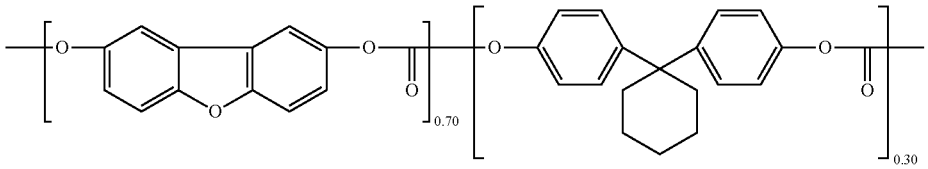

(Resin-10)

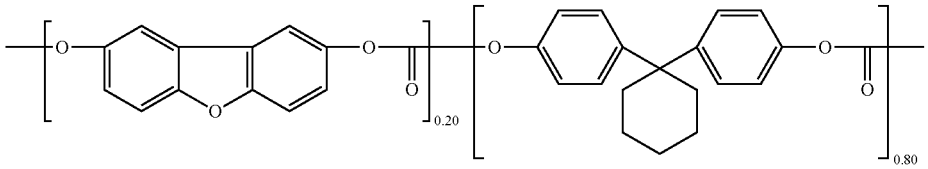

No particular limitation is placed on a method for producing the binder resin as long as the polycarbonate resin (2) can be produced. Examples of methods for producing the binder resin include an interfacial condensation polymerization method of a diol compound and phosgene for forming repeating units of a polycarbonate resin (a so-called phosgene method), and a method for causing ester exchange reaction between a diol compound and diphenyl carbonate. A more specific example method involves interfacial condensation polymerization of phosgene and a mixture obtained by mixing a diol compound represented by general formula (6) with a diol compound represented by general formula (7) so that the repeating unit (5) has a molar rate of 60% by mole (n=0.60). Note that Ar in general formula (6) and $R_3$-$R_5$ in general formula (7) are the same as defined for Ar and $R_3$-$R_5$ in general formula (2), respectively.

$$HO—Ar—OH \quad (6)$$

-continued (7)

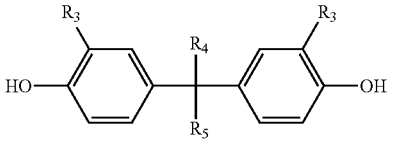

The binder resin may optionally contain a binder resin in addition to the polycarbonate resin (2). Examples of other binder resins that may be optionally contained include those listed as above as examples of the base resins.

The binder resin preferably has a viscosity average molecular weight of at least 40,000, and more preferably at least 40,000 and no greater than 52,500. In a configuration in which the binder resin has a viscosity average molecular weight of at least 40,000, abrasion resistance of the binder resin can be sufficiently improved, resulting in that the photosensitive layer 3 is hardly worn out. By contrast, in a configuration in which the binder resin has a viscosity average molecular weight of no greater than 52,500, the binder resin tends to readily dissolve in a solvent in formation of the photosensitive layer 3. An application liquid for photosensitive layer formation can be accordingly inhibited from excessively increasing in viscosity. As a result, formation of the photosensitive layer 3 can be facilitated.

[2-2-3. Electron Acceptor Compound]

The electron acceptor compound preferably has a ketone structure or a dicyanomethylene structure and more preferably contains at least one (for example, one) of compounds represented by general formula (3).

(3)

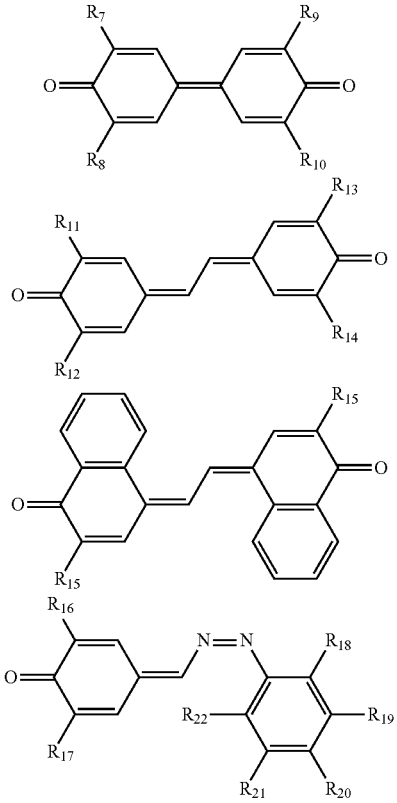

-continued

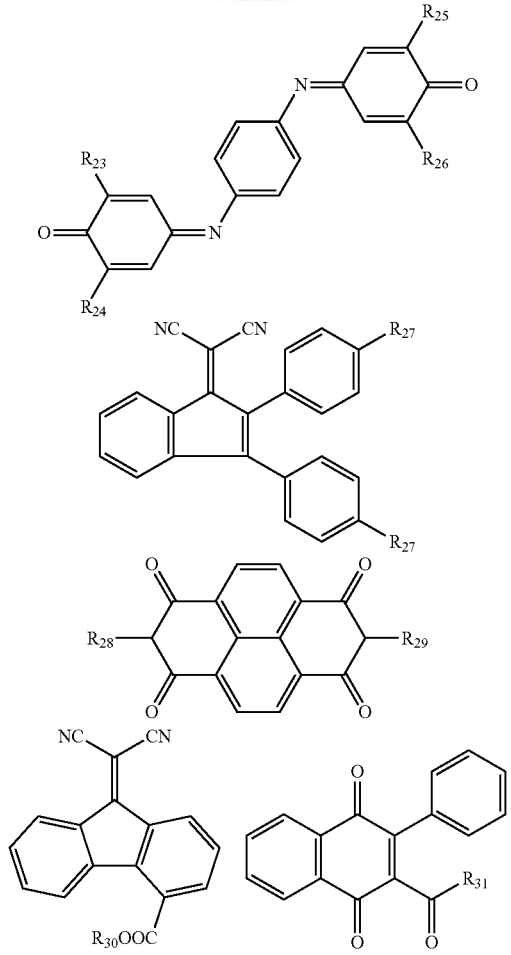

In general formula (3), $R_7$-$R_{31}$ represent, independently of one another, an alkyl group having a carbon number of at least 1 and no greater than 5, a hydrogen atom, a halogen atom, an arylalkoxy group, or an aryl group optionally having an alkoxy group or an alkyl group having a carbon number of at least 1 and no greater than 3.

Preferable examples of alkyl groups having a carbon number of at least 1 and no greater than 5 represented by $R_7$-$R_{31}$ in general formula (3) include a methyl group, an ethyl group, an n-butyl group, a tert-butyl group, and a tert-pentyl group.

An arylalkoxy group represented by $R_7$-$R_{31}$ in general formula (3) is for example a substituent of an aryl group represented by $R_1$ in general formula (1) to which an alkoxy group having a carbon number of at least 1 and no greater than 5 is bonded. The arylalkoxy group is preferably a phenylmethoxy group.

Examples of aryl groups represented by $R_7$-$R_{31}$ in general formula (3) include aryl groups having a carbon number of at least 6 and no greater than 12 with a phenyl group being preferable. The aryl group may be substituted. Examples of substituents of the aryl group include alkyl groups having a carbon number of at least 1 and no greater than 3 and alkoxy group having a carbon number of at least 1 and no greater than 3. An alkoxy group that the aryl group may have is the same as defined for an alkoxy group having a carbon number of at least 1 and no greater than 4 that the aryl group represented by $R_1$ in general formula (1) has.

[2-3. Additive]

The photosensitive layer 3 may contain various types of additives. Examples of additives that can be used include antidegradants (specific examples include a radical scavenger, a singlet quencher, and a ultraviolet absorbing agent), softeners, surface modifiers, bulking agents, thickeners, dispersion stabilizers, waxes, antioxidants, donors, surfactants, plasticizers, sensitizers, and leveling agents.

Examples of possible sensitizers include terphenyl, halo naphthoquinones, and acenaphthylene. In a configuration in which the charge generating layer 3*a* contains a sensitizer, sensitivity of the charge generating layer 3*a* tends to increase.

Examples of antioxidants include compounds having a phenol structure (phenol-based antioxidants).

[3. Intermediate Layer]

The intermediate layer 4 (particularly, undercoat layer) can be disposed between the conductive substrate 2 and the photosensitive layer 3 of the photosensitive member 1. The intermediate layer 4 contains for example inorganic particles and a resin used for formation of the intermediate layer 4 (resin for intermediate layer formation). In a configuration in which the intermediate layer 4 is present, an insulating state can be maintained to an extent that a leakage can be inhibited from occurring and electric current generated in exposure of the photosensitive member 1 can be allowed to flow smoothly. As a result, resistance can be prevented from increasing.

Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used, or a combination of two or more types of the inorganic particles listed above may be used.

No particular limitation is placed on the resin for forming the intermediate layer 4 as long as it can be used for forming the intermediate layer 4.

The intermediate layer 4 may contain various types of additives as long as such additives do not adversely affect electrophotographic properties of the photosensitive member 1. Examples of additives include those listed as above as examples of additives for the photosensitive layer 3.

The photosensitive member 1 according to the first embodiment can be used as an image bearing member of an electrographic image forming apparatus. No limitation is placed on the image forming apparatus as long as an electrographic method can be adopted in the image forming apparatus. Specifically, the photosensitive member 1 according to the first embodiment can be used as an image bearing member of an image forming apparatus described later, for example.

The photosensitive member 1 according to the first embodiment has been described so far. The photosensitive member 1 according to the first embodiment includes the charge generating layer that contains a Y-form titanyl phthalocyanine and the charge transport layer that contains the triarylamine derivative (1) that is a hole transport material and the polycarbonate resin (2) that is a binder resin. The hole transport material has a mass ratio of no greater than 0.55 relative to a mass of the binder resin. In the above configuration, the photosensitive member 1 according to the first embodiment is excellent in electrical characteristics and abrasion resistance.

<Second Embodiment: Photosensitive Member Production Method>

[1. Photosensitive Layer Formation Process]

With reference to FIG. 1, an example of a method for producing a photosensitive member 1 will be described next. The method for producing the photosensitive member 1 of the first embodiment involves a photosensitive layer formation process. The photosensitive layer formation process involves a charge generating layer formation process and a charge transport layer formation process.

[1-1. Charge Generating Layer Formation Process]

In the charge generating layer formation process, an application liquid for charge generating layer formation is applied onto the conductive substrate 2 and a solvent contained in the applied application liquid for charge generating layer formation is removed to form the charge generating layer 3*a*. The application liquid for charge generating layer formation contains a base resin, a solvent, and Y-form titanyl phthalocyanine crystals that function as a charge generating material. The application liquid for charge generating layer formation can be prepared by dissolving or dispersing the Y-form titanyl phthalocyanine crystals and the base resin in the solvent. Various additives may be added to the application liquid for charge generating layer formation depending on necessity.

[1-2. Charge Transport Layer Formation Process]

In the charge transport layer formation process, an application liquid for charge transport layer formation is applied onto the charge generating layer 3*a* and at least a part of the solvent contained in the applied application liquid for charge transport layer formation is removed to form the charge transport layer 3*b*. The application liquid for charge transport layer formation contains the triarylamine derivative (1) that is a hole transport material, the polycarbonate resin (2) that is a binder resin, and a solvent. The application liquid for charge transport layer formation can be prepared by dissolving or dispersing the triarylamine derivative (1) and the polycarbonate resin (2) in the solvent. Various additives may be added to the application liquid for charge transport layer formation depending on necessity.

The following describes a photosensitive layer formation process in detail by referring to the charge generating layer formation process and the charge transport layer formation process as examples.

No particular limitation is placed on the respective solvents contained in the application liquid for charge generating layer formation and the application liquid for charge transport layer formation as long as they can dissolve or disperse respective components contained in the application liquid for charge generating layer formation and the application liquid for charge transport layer formation. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and 1,4-dioxane), ketones (specific examples include acetone, methyl ethyl ketone, and cyclohexanone), esters (specific examples include ethyl acetate and methyl acetate), dimethyl formaldehyde, N,N-dimethylformamide (DMF), and dimethyl sulfoxide. Any one of the solvents listed above may be used or a combination of any two or more of the solvents listed above may be used. The solvent contained in the application liquid for charge generating layer formation is preferably a nonhalogen solvent among the solvents listed above.

The solvent contained in the application liquid for charge transport layer formation preferably contains at least one of toluene, 1,4-dioxane, tetrahydrofuran (THF), and o-xylene, which can uniformly dissolve or disperse the triarylamine derivative (1) that is a hole transport material and the polycarbonate resin (2) that is a binder resin. The triarylamine derivative (1) and the polycarbonate resin (2) are excellent in dispersibility in the respective solvents listed above. For this reason, preparation of the application liquid for charge transport layer formation in which the triarylamine derivative (1) is uniformly dispersed can be facilitated. Formation of the charge transport layer using the application liquid for charge transport layer formation as above can facilitate formation of the charge transport layer in which the triarylamine derivative (1) is dispersed uniformly. Examples of mixed solvents of substantially two types of solvents among the solvents as above used in the application liquid for charge transport layer formation include a mixed solvent of THF and toluene, a mixed solvent of THF an 1,4-dioxane, and a mixed solvent of THF and o-xylene.

Moreover, the solvent contained in the application liquid for charge transport layer formation is preferably different from the solvent contained in the application liquid for charge generating layer formation. In formation of the photosensitive member 1, typically, the charge generating layer 3*a* is formed first and the charge transport layer 3*b* is then formed. Specifically, the application liquid for charge transport layer formation is applied onto the charge generating layer 3*a*. As such, the charge generating layer 3*a* is required to be insoluble in the solvent of the application liquid for charge transport layer formation in formation of the charge transport layer 3*b*.

The application liquid for charge generating layer formation and the application liquid for charge transport layer formation can be each prepared by mixing the components and dispersing the mixed components in the solvent. Mixing or dispersion can be carried out using for example a bead mill, a roll mill, a ball mill, an attritor, a paint shaker, or a ultrasonic disperser.

The application liquid for charge generating layer formation and the application liquid for charge transport layer formation may each contain for example a surfactant or a leveling agent in order to improve smoothness of the surface of the corresponding layer to be formed.

No particular limitation is placed on methods for applying the application liquid for charge generating layer formation and the application liquid for charge transport layer formation as long as for example the respective methods can attain uniform application of the application liquid for charge transport layer formation onto the conductive substrate 2. Examples of application methods that can be adopted include dip coating, spray coating, spin coating, and bar coating.

No particular limitation is placed on methods for removing at least parts of the respective solvents contained the application liquid for charge generating layer formation and the application liquid for charge transport layer formation as long as the methods can remove (specifically, evaporate or the like) at least parts of the respective solvents contained the application liquid for charge generating layer formation and the application liquid for charge transport layer formation. Examples of methods for removing the respective solvents include heating, depressurization, and a combination of heating and depressurization. More specific examples include heating (hot-air drying) using a high-temperature dryer or a reduced pressure dryer. Such heating is carried out for example at a temperature of at least 40° C. and no greater than 150° C. for at least 3 minutes and no greater than 120 minutes.

Note that the method for producing the photosensitive member 1 may further involve either or both of formation of an intermediate layer 4 and formation of a protective layer 5. Any known methods can be appropriately selected for forming the intermediate layer 4 and forming the protective layer 5.

The method for producing the photosensitive member 1 according to the second embodiment has been described so far. In the method for producing the photosensitive member 1 according to the second embodiment, the photosensitive member 1 is produced through formation of a charge transport layer using a solvent containing at least one of toluene, 1,4-dioxane, tetrahydrofuran, and o-xylene. As a result, a photosensitive member excellent in electrical characteristics and abrasion resistance can be produced.

<Third Embodiment: Image Forming Apparatus>

Figure 3:
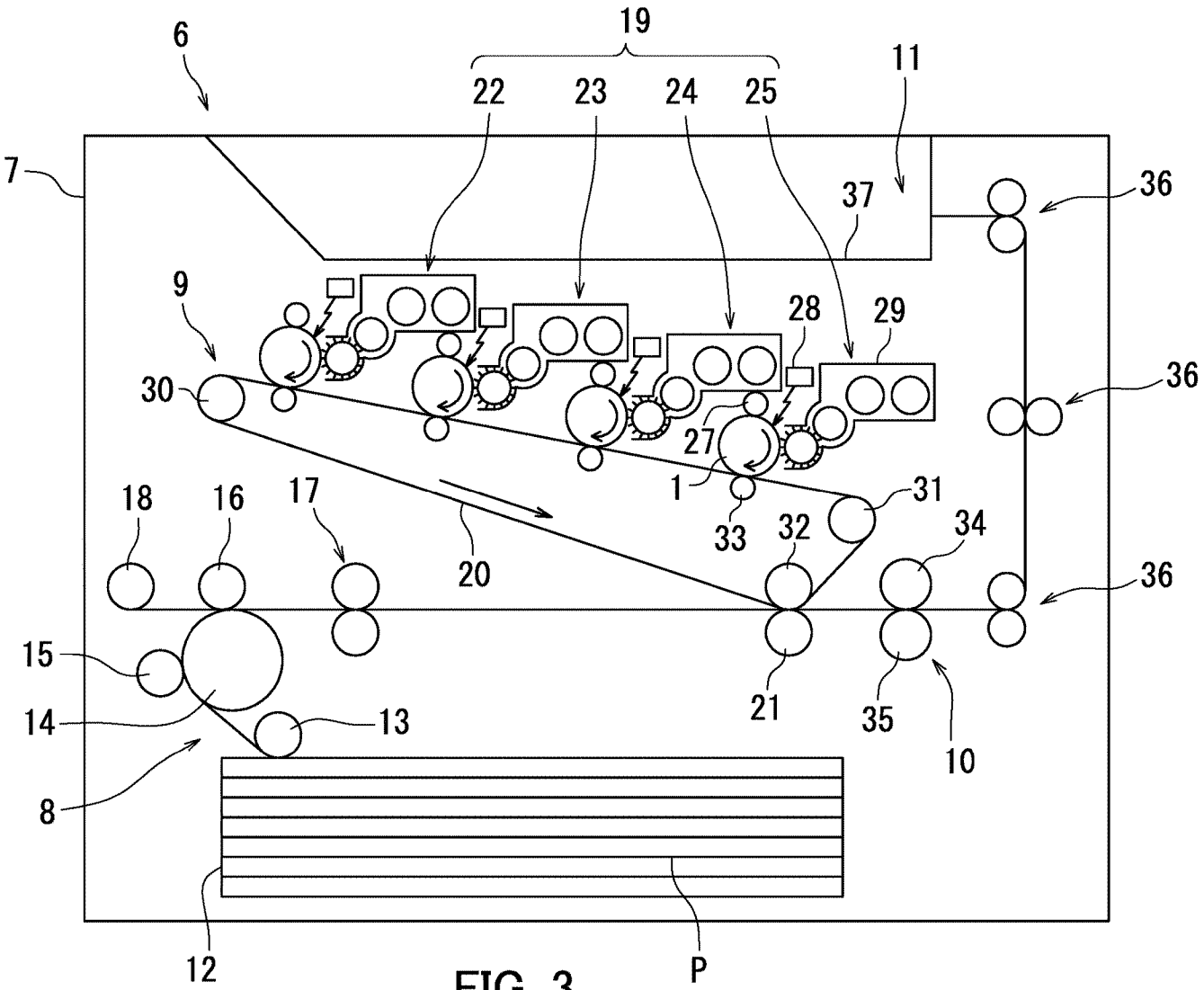
FIG. 3 roughly illustrates an example of an image forming apparatus according to a third embodiment.

A third embodiment is directed to an image forming apparatus. Following describes an example of an image forming apparatus according to the third embodiment with reference to FIG. 3. FIG. 3 roughly illustrates a configuration of an image forming apparatus according to the third embodiment. An image forming apparatus 6 includes the photosensitive member 1 of the first embodiment. The photosensitive member 1 is used as an image bearing member.

The image forming apparatus 6 according to the third embodiment includes an image bearing member 1 that is the photosensitive member 1, a charger 27 corresponding to a charging device, an light exposure section 28 corresponding to an exposure device, a development section 29 corresponding to a developing device, and a transfer section. The charger 27 negatively charges the surface of the image bearing member 1. The charge polarity of the charger 27 is negative. The light exposure section 28 develops the charged surface of the image bearing member 1 to form an electrostatic latent image on the surface of the image bearing member 1. The development section 29 develops the electrostatic latent image into a toner image. The transfer section transfers the toner image from the image bearing member 1 to a transfer target (an intermediate transfer belt 20). In a configuration in which the image forming apparatus 6 adopts an intermediate transfer method, the transfer section corresponds to primary transfer rollers 33 and a secondary transfer roller 21. The image bearing member 1 is the photosensitive member 1 of the first embodiment.

No particular limitation is placed on the image forming apparatus 6 as long as being an electrographic image forming apparatus. The image forming apparatus 6 may be a monochrome image forming apparatus or a color image forming apparatus, for example. The image forming apparatus 6 may be a tandem color image forming apparatus in order to form toner images in different colors using toners different in color.

A tandem color image forming apparatus will be described below as an example of the image forming apparatus 6. The image forming apparatus 6 includes a plurality of photosensitive members 1 arranged side by side in a specific direction and a plurality of development sections 29. The development sections 29 are each disposed opposite to a corresponding one of the photosensitive members 1. The development sections 29 each include a development roller.

The development roller carries and conveys toner and supplies the toner to the surface of the corresponding image bearing member 1.

As illustrated in FIG. 3, the image forming apparatus 6 includes a box-shaped apparatus housing 7. A paper feed section 8, an image forming section 9, and a fixing section 10 are accommodated in the apparatus housing 7. The paper feed section 8 feeds paper P. The image forming section 9 transfers a toner image based on image data to the paper P fed from the paper feed section 8 while conveying the paper P. The fixing section 10 fixes, to the paper P, an unfixed toner image that has been transferred to the paper P by the image forming section 9. Furthermore, a paper ejection section 11 is disposed on top of the apparatus housing 7. The paper ejection section 11 ejects the paper P subjected to fixing by the fixing section 10.

The paper feed section 8 includes a paper feed cassette 12, a first pickup roller 13, paper feed rollers 14, 15, and 16, and a pair of registration rollers 17. The paper feed cassette 12 is attachable to and detachable from the apparatus housing 7. The paper feed cassette 12 stores paper P of various sizes. The first pickup roller 13 is disposed in a left upper part of the paper feed cassette 12. The first pickup roller 13 picks up the paper P stored in the paper feed cassette 12 one sheet at a time. The paper feed rollers 14-16 convey the paper P picked up by the first pickup roller 13. The pair of registration rollers 17 temporarily halts the paper P, which is conveyed by the paper feed rollers 14-16, and subsequently feeds the paper P to the image forming section 9 at a specific timing.

The paper feed section 8 further includes a manual feed tray (not illustrated) and a third pickup roller 18. The manual feed tray is attached to a left side surface of the apparatus housing 7. The third pickup roller 18 picks up paper P loaded on the manual feed tray. The paper P picked up by the third pickup roller 18 is conveyed by the paper feed rollers 14-16 and supplied to the image forming section 9 at a specific timing by the pair of registration rollers 17.

The image forming section 9 further includes an image forming unit 19, the intermediate transfer belt 20, and the secondary transfer roller 21. The image forming unit 19 primarily transfers the toner images to the circumferential surface (contact surface in contact with the surface of the image bearing member 1) of the intermediate transfer belt 20. Note that the toner images that is subjected to primary transfer is formed based on image data that is transmitted from a higher-level device such as a computer. The secondary transfer roller 21 secondarily transfers the toner image on the intermediate transfer belt 20 to the paper P fed from the paper feed cassette 12.

The image forming unit 19 includes a yellow toner supply unit 25, a magenta toner supply unit 24, a cyan toner supply unit 23, and a black toner supply unit 22. In the image forming unit 19, the yellow toner supply unit 25, the magenta toner supply unit 24, the cyan toner supply unit 23, and the black toner supply unit 22 are arranged in the stated order starting from the yellow toner supply unit 25 from upstream (right side of FIG. 3) to downstream in a circulation direction of the intermediate transfer belt 20. The photosensitive members 1 are each disposed at a central part of a corresponding one of the units 22-25. The photosensitive members 1 are rotatable in respective arrow directions (clockwise). Note that the units 22-25 may each be a process cartridge attachable to and detachable from the main body of the image forming apparatus 6, which will be described later.

The charger 27, the light exposure section 28, and the development section 29 are disposed around each of the image bearing members 1 in the stated order starting from the charger 27 from upstream to downstream in respective directions of rotation of the image bearing members 1.

A static eliminator (not illustrated) and a cleaner (not illustrated) may be provided upstream of each charger 27 in the rotation direction of the corresponding image bearing member 1. The static eliminator performs static elimination on the circumferential surface (surface) of the corresponding image bearing member 1 after primary transfer of the corresponding toner image to the intermediate transfer belt 20. The circumferential surface of the image bearing member 1 cleaned by the cleaner and subjected to static elimination by the static eliminator comes to the charger 27 to be newly charged.

Note that the image forming apparatus 6 according to the third embodiment can include either or both a cleaning section corresponding to the cleaner and a static eliminating section corresponding to the static eliminator. In a configuration in which the image forming apparatus 6 in the third embodiment includes both the cleaning section and the static eliminating section, the charger 27, the light exposure section 28, the development section 29, the transfer section, the cleaning section, and the static eliminating section are disposed in the stated order starting from the charger 27 from upstream to downstream in the rotation direction of each image bearing member 1.

As described above, the charger 27 charges the surface of the image bearing member 1. Specifically, the charger 27 uniformly charges the surface of the image bearing member 1. No particular limitation is placed on the charger 27 as long as it can uniformly charge the surface of the image bearing member 1. The charger 27 may be of non-contact type or contact type. Examples of such a contact type charger 27 include a charging roller and a charging brush. A contact type charger (specifically, a charging roller or a charging brush) is preferable as the charger 27. The use of the charger 27 of contact type can reduce emission of active gas (for example, ozone or nitrogen oxide) generated from the charger 27. As a result, degradation of the photosensitive layer 3 due to the presence of active gas can be prevented and layout that takes an office environment into consideration can be generated.

In a configuration in which the charger 27 includes a contact type charging roller, the charging roller charges the surface of the image bearing member 1 while in contact with the image bearing member 1. An example of such a charging roller is a charging roller that follows the rotation of the image bearing member 1 to rotate while in contact with the surface of the image bearing member 1. Another example of the charging roller is a charging roller at least a surface portion of which is made from a resin. Specifically, the charging roller includes a metal core that is axially supported in a rotatable manner, a resin layer disposed on the metal core, and a voltage application section that applies voltage to the metal core. In the charger 27 including the charging roller as above, when the voltage application section applies voltage to the metal core, the surface of the photosensitive member 1 in contact with the charger 27 can be charged through the resin layer.

No particular limitation is placed on resin that forms the resin layer of the charging roller as long as the surface of the image bearing member 1 can be charged favorably. Specific examples of resin that can be used for forming the resin layer include silicone resins, urethane resins, and silicone modified resins. The resin layer may contain an inorganic filler.

No particular limitation is placed on voltage that the charger 27 applies. However, the charger 27 preferably applies only direct current voltage rather than alternating current voltage or superimposed voltage in which direct current voltage is superimposed by alternating current voltage. The reason thereof is such that an abrasion amount of the photosensitive layer 3 tends to decrease in a configuration in which the charger 27 applies only direct current voltage. As a result, a favorable image can be formed. The direct current voltage that the charger 27 applies to the photosensitive member 1 is preferably at least 1,000 V and no greater than 2,000 V, more preferably at least 1,200 V and no greater than 1,800 V, and particularly preferably at least 1,400 V and no greater than 1,600 V.

The light exposure section 28 is a laser scanning unit, for example. The light exposure section 28 exposes the surface of the charged image bearing member 1 to form an electrostatic latent image on the surface of the image bearing member 1. Specifically, the light exposure section 28 irradiates the circumferential surface of the image bearing member 1, which is uniformly charged by the charger 27, with laser light based on image data input from a higher-level device such as a personal computer. Through the above, the electrostatic latent image based on the image data is formed on the circumferential surface of the image bearing member 1.

As already described above, the development section 29 develops the electrostatic latent image into a toner image. Specifically, the development section 29 forms a toner image based on the image data by supplying toner to the circumferential surface of the image bearing member 1 on which the electrostatic latent image is formed. The toner image formed on the image bearing member 1 is primarily transferred to the intermediate transfer belt 20. Note that the charge polarity of the toner is negative.

The intermediate transfer belt 20 is an endless circulating belt. The intermediate transfer belt 20 is wound around a drive roller 30, a driven roller 31, a backup roller 32, and the primary transfer rollers 33. The intermediate transfer belt 20 is disposed such that the respective circumferential surfaces of the plurality of image bearing members 1 are in contact with the circumferential surface of the intermediate transfer belt 20.

The intermediate transfer belt 20 is pressed against the image bearing members 1 by the respective primary transfer rollers 33 each located opposite to a corresponding one of the image bearing members 1. The intermediate transfer belt 20 is endlessly circulated in an arrow direction (anticlockwise) by the drive roller 30 while being pressed. The drive roller 30 is rotationally driven by a drive source such as a stepper motor and imparts driving force on the intermediate transfer belt 20 that causes endless circulation of the intermediate transfer belt 20. The driven roller 31, the backup roller 32, and the primary transfer rollers 33 are disposed in a rotatable manner. The driven roller 31, the backup roller 32, and the primary transfer rollers 33 are rotationally driven in accompaniment to endless circulation of the transfer belt 40 by the drive roller 3. The driven roller 31, the backup roller 32, and the primary transfer rollers 33 are rotationally driven by the active rotation of the drive roller 30 via the intermediate transfer belt 20 and support the intermediate transfer belt 20.

The primary transfer rollers 33 each transfer a toner image from a corresponding one of the image bearing members 1 to the intermediate transfer belt 20. Specifically, the primary transfer rollers 33 each apply primary transfer bias (specifically, bias of which polarity is opposite to that of the toner) to the intermediate transfer belt 20. As a result, toner images formed on the respective photosensitive members 1 are transferred (primary transfer) onto the intermediate transfer belt 20 in order as the intermediate transfer belt 20 is driven by the drive roller 30 to circulate between each of the photosensitive members 1 and the corresponding primary transfer rollers 33.

The secondary transfer roller 21 applies secondary transfer bias (specifically bias of which polarity is opposite to that of the toner images) to the paper P. Through the above, the toner images primarily transferred to the intermediate transfer belt 20 are transferred to the paper P between the secondary transfer roller 21 and the backup roller 32. Thus, unmixed toner images are transferred to the paper P.

The fixing section 10 fixes, to the paper P, the unfixed toner images transferred to the paper P in the image forming section 9. The fixing section 10 includes a heating roller 34 and a pressure roller 35. The heating roller 34 is heated by a conductive heating element. The pressure roller 35 is located opposite to the heating roller 34 such that the circumferential surface of the pressure roller 35 is pressed against the circumferential surface of the heating roller 34.

The toner images transferred to the paper P by the secondary transfer roller 21 in the image forming section 9 are fixed to the paper P through fixing treatment by heating during the paper P passing between the heating roller 34 and the pressure roller 35. The paper P subjected to fixing is ejected to the paper ejection section 11. A plurality of conveyance rollers 36 are disposed at appropriate locations between the fixing section 10 and the paper ejection section 11.

The paper ejection section 11 is formed by a recess in a top part of the apparatus housing 7. An exit tray 37 for receiving ejected paper P is provided at the bottom of the recess. The image forming apparatus 6 according to the third embodiment has been described so far with reference to FIG. 3.

The image forming apparatus 6 described with reference to FIG. 3 adopts an intermediate transfer method. However, the image forming apparatus 6 according to the third embodiment may adopt a direct-transfer method in another aspect. In the above configuration, the transfer target corresponds to a recording medium (for example, paper P). Further, the transfer section corresponds to the secondary transfer roller 21. The secondary transfer roller 21 is disposed so as to allow the recording medium to pass between the secondary transfer roller 21 and an image bearing member 1 located opposite to the secondary transfer roller 21.

As described with reference to FIG. 3, the image forming apparatus 6 according to the third embodiment includes, as an image bearing member, the photosensitive member 1 according to the first embodiment that is excellent in electrical characteristics and abrasion resistance. In a configuration including the photosensitive member 1 as above, an image defect can be inhibited from occurring in the image forming apparatus 6 according to the third embodiment.

<Fourth Embodiment: Process Cartridge>

A fourth embodiment is directed to a process cartridge. The process cartridge according to the fourth embodiment includes the photosensitive member 1 of the first embodiment as an image bearing member. The process cartridge can include the photosensitive member 1 of the first embodiment that is unified as an image bearing member, for example. The process cartridge may be arranged attachably to and detachably from the image forming apparatus 6 of the third embodiment. The process cartridge can have a configuration for example in which at least one of a charger, a light exposure section, a development section, a transfer section, a cleaning section, and a static eliminating section is unified together with the image bearing member 1. Here, the charger, the light exposure section, the development section, the transfer section, the cleaning section, and the static eliminating section may have the same configurations as the charger 27, the light exposure section 28, the development section 29, the transfer section, the cleaning section, and the static eliminating section, respectively.

The process cartridge according to the fourth embodiment has been described so far. The process cartridge according to the fourth embodiment is excellent in electrical characteristics and abrasion resistance. Furthermore, a process cartridge as above is easy to handle. Therefore, the process cartridge including the photosensitive member 1 can be easily and quickly replaced in a situation in which the photosensitive member 1 degrades in sensitivity characteristics or the like.

EXAMPLES

The following provides more specific description of the present disclosure through examples. Note that the present disclosure is not in any way limited by the following example.

[1. Production of Photosensitive Member]

Photosensitive members (A-1)-(A-34) and (B-1)-(B-5) were produced using a charge generating material, hole transport materials, electron acceptor compounds, and binder resins.

[1-1. Preparation of Charge Generating Material]

For production of the photosensitive members (A-1)-(A-34) and (B-1)-(B-5), Y-form titanyl phthalocyanine crystals represented by chemical formula (CG-1) (also referred to below as a charge generating material (CG-1)) were used as a charge generating material. An X-ray diffraction spectrum of the Y-form titanyl phthalocyanine crystals was measured using an X-ray diffraction spectrometer. When the obtained X-ray diffraction spectrum was measured, a main peak was observed at a Bragg angle (2θ±2°) of 27.2. A differential scanning calorimetry spectrum of the charge generating material (CG-1) was measured using a differential scanning calorimeter (TAS-200 DSC 8230D produced by Rigaku Corporation). Is was confirmed from the obtained differential scanning calorimetry spectrum that the Y-form titanyl phthalocyanine crystals exhibited a single peak in a temperature range of at least 270° C. and no greater than 400° C. other than a peak resulting from vaporization of absorbed water.

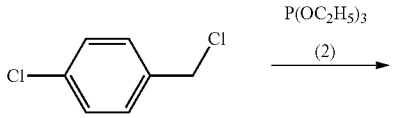

(1a)

[1-2. Preparation of Hole Transport Material]

For preparing the photosensitive members (A-1)-(A-34) and (B-1)-(B-5), 5 triarylamine derivatives represented by chemical formulas (HTM-1)-(HTM-12) (also referred to below as hole transport materials (HTM-1)-(HTM-12)) were used as hole transport materials. The triarylamine derivatives represented by chemical formulas (HTM-11)-(HTM-12) are shown below.

(HTM-11)

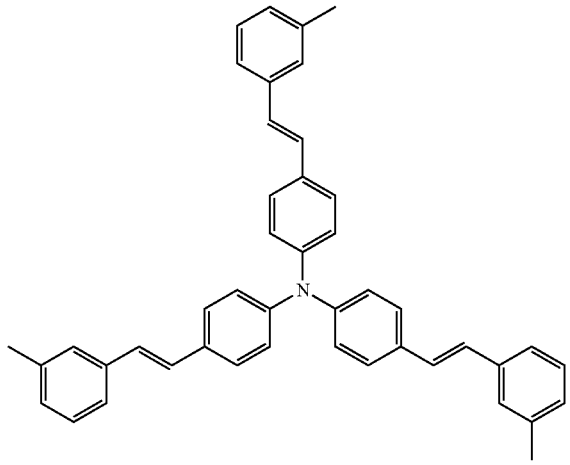

(HTM-12)

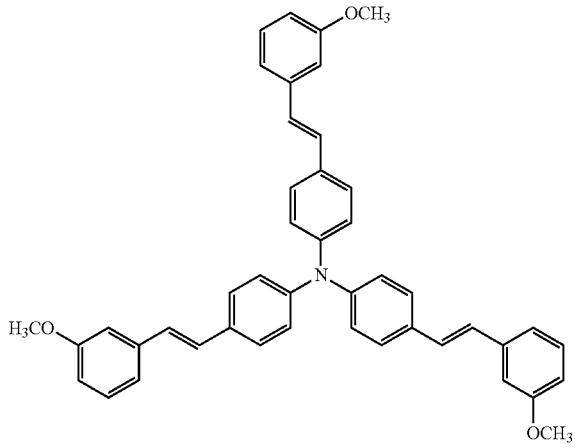

[1-2-1. Synthesis of Hole Transport Material (HTM-1)]

The hole transport material (HTM-1) was synthesized according to the following reaction scheme. The following describes a specific reaction scheme.

-continued

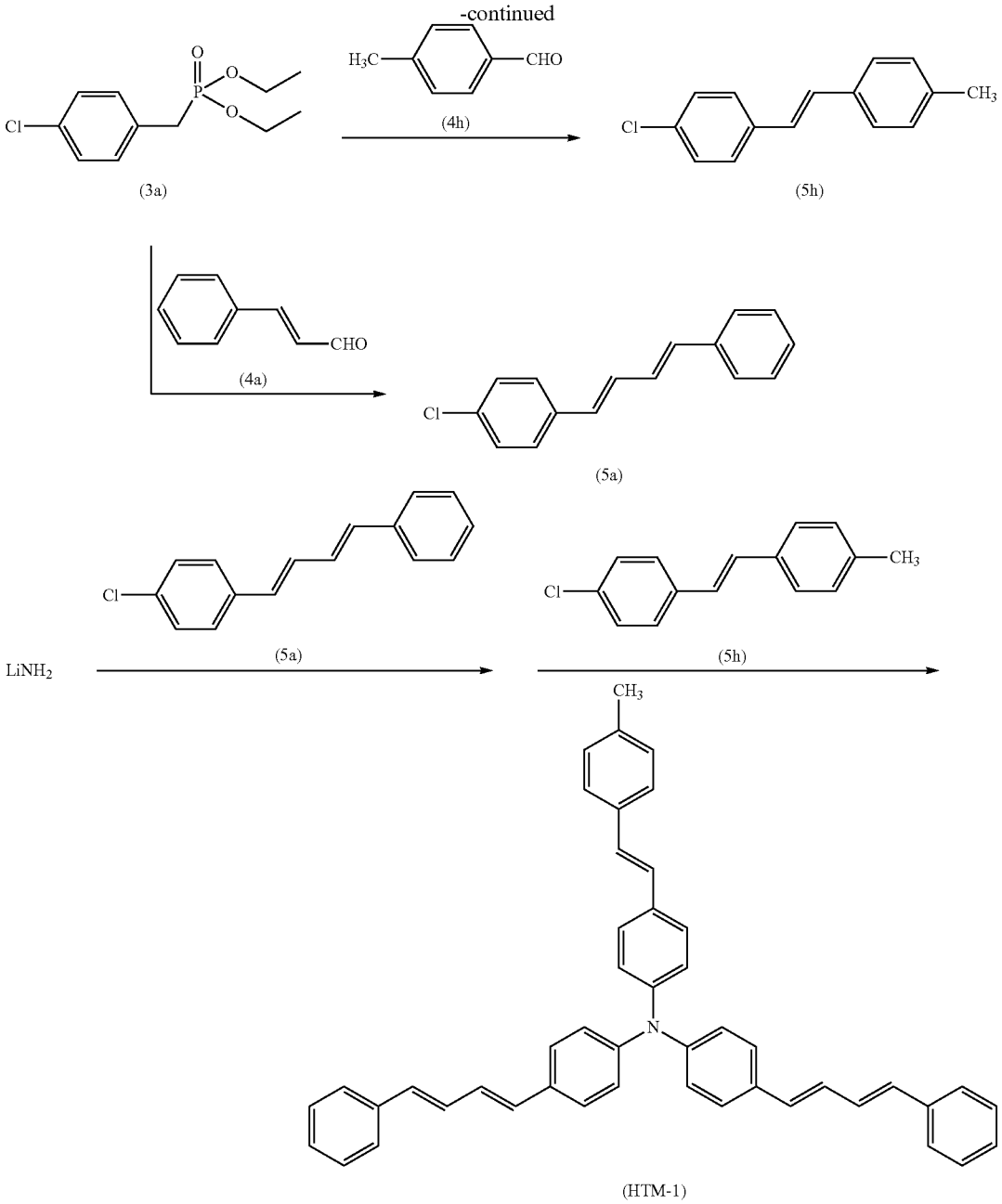

(Synthesis of Compound (3a))

A compound (1a) (16.1 g, 0.1 moles) and triethyl phosphite (25 g, 0.15 moles) that is a compound (2) were added to a 200-mL flask, stirred at a temperature of 180° C. for 8 hours, and then cooled to room temperature. Thereafter, excess triethyl phosphite was evaporated under reduced pressure to yield 24.1 g of a compound (3a) (percentage yield 92% by mole, white liquid).

(Synthesis of Compound (5a))

The yielded compound (3a) (13 g, 0.05 moles) was added to a 500-mL two-necked flask at a temperature of 00. Gas in the flask was replaced with argon gas. Thereafter, dry tetrahydrofuran (100 mL) and 28% sodium methoxide (9.3 g, 0.05 moles) were added to the flask and a resultant substance was stirred for 30 minutes. A dry tetrahydrofuran (300 mL) solution of a compound (4a) (7 g, 0.05 moles) was added and a resultant mixture was stirred at room temperature for 12 hours. The resultant mixture was poured into ion exchanged water and extraction was performed using toluene. A resultant organic layer was washed five times using ion exchanged water. After drying the washed organic layer using anhydrous sodium sulfate, solvent evaporation was performed. A resultant residue was purified using toluene/methanol (20 mL/100 mL) to yield 9.8 g of a compound (5a) (yield percentage 80% by mole, white crystals).

(Synthesis of Compound (5h))

The yielded compound (3a) (13 g, 0.05 moles) was added to 500-mL two-necked flask at a temperature of 0° C. Gas in the flask was replaced with argon gas. Thereafter, dry tetrahydrofuran (100 mL) and 28% sodium methoxide (9.3 g, 0.05 moles) were added to the flask and a resultant mixture was stirred for 30 minutes. Thereafter, a dry tetrahydrofuran solution (300 mL) of a compound (4h) (5 g, 0.05 moles) was added and a resultant substance was stirred at room temperature for 12 hours. A resultant mixture was poured into ion exchanged water and extraction was performed using toluene. A resultant organic layer was washed five times using ion exchanged water. After drying the washed organic layer using anhydrous sodium sulfate, solvent evaporation was performed. A resultant residue was purified using toluene/methanol (20 mL/100 mL) to yield 9.8 g of a compound (5h) (yield percentage 80% by mole, white crystals).

(Synthesis of Intermediate Compound of Hole Transport Material (HTM-1))

A three-necked flask was charged with the yielded compound (5a) (6 g, 0.02 moles), tricyclohexylphosphine (0.0662 g, 0.000189 moles), tris(dibenzylideneacetone)dipalladium(0) (0.0864 g, 0.0000944 moles), sodium tert-butoxide (4 g, 0.42 moles), lithium amide (0.24 g, 0.010 mole), and distilled o-xylene (500 mL). Gas in the flask was replaced with argon gas. Thereafter, the flask contents were stirred at a temperature of 120° C. for five hours and cooled to room temperature. A resultant mixture was washed using ion exchanged water three times to obtain an organic layer. Anhydrous sodium sulfate and activated clay were added to the organic layer in order to perform drying treatment and adsorption treatment. Next, the resultant organic layer was subjected to reduced pressure evaporation in order to remove o-xylene. A resultant residue was crystallized using chloroform/hexane (volume ratio 1:1) to yield 2.6 g of the intermediate compound of the hole transport material (HT-1).

[Synthesis of Hole Transport Material (HTM-1)]

A three-necked flask was charged with the resultant intermediate compound (2.6 g, 0.006 moles), the compound (5h) (1.5 g, 0.006 moles), tricyclohexylphosphine (0.020604 g, $5.887\times10^{-5}$ moles), tris(dibenzylideneacetone)dipalladium(0) (0.026933 g, $2.943\times10^{-5}$ moles), sodium tert-butoxide (1 g, 0.010 moles), and distilled o-xylene (200 mL). Gas in the flask was replaced with argon gas. Thereafter, the flask contents were stirred at a temperature of 120° for five hours and cooled to room temperature. A resultant mixture was washed three times using ion exchanged water to obtain an organic layer. Anhydrous sodium sulfate and activated clay were added to the organic layer in order to perform drying treatment and adsorption treatment. Next, the resultant organic layer was subjected to reduced pressure evaporation in order to remove o-xylene. A resultant residue was purified using chloroform/hexane (volume ratio 1:1) as a developing solvent according to silica gel column chromatography to yield 3.8 g of the hole transport material (HTM-1) (percentage yield 63% by mole).

A $^1$H-NMR spectrum of the yielded compound was measured using a $^1$H-NMR spectrometer (300 MHz). In the measurement, $CDCl_3$ was used as a solvent and TMS was used as a reference substance. The measured $^1$H-NMR spectrum was similar to that shown in FIG. 2. The yielded compound was confirmed as the hole transport material (HTM-1).

Hole transport material (HTM-1): $^1$H-NMR (300 MHz, $CDCl_3$) δ=7.51-7.21 (m, 15H), 7.15-7.03 (m, 12H), 6.96-6.81 (m, 4H), 6.64-6.56 (m, 4H), 2.34 (s, 6h).

[Synthesis of Hole Transport Material (HTM-2)]

The following compound (5b) (percentage yield 85% by mole) was yielded according to the same method as that for the compound (5h) in all aspects other than that the following compound (4b) was used instead of the compound (4h). Next, an intermediate compound was yielded according to the same method as that for the intermediate compound of the hole transport material (HTM-1). Thereafter, the hole transport material (HTM-2) (percentage yield 65% by mole) was yielded according to the same method as that for the hole transport material (HTM-1) in all aspects other than that the compound (5b) was used instead of the compound (5h).

The yielded hole transport material (HTM-2) was measured using a 300-MHz $^1$H-NMR (proton nuclear magnetic resonance) spectrometer. As a solvent, $CDCl_3$ was used. It was confirmed from the measured $^1$H-NMR spectrum that the hole transport material (HTM-2) was yielded.

(4b)

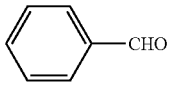

(5b)

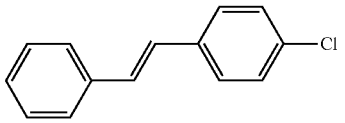

[Synthesis of Hole Transport Material (HTM-3)]

The following compound (5c) (percentage yield 40% by mole) was yielded according to the same method as that for the compound (5a) in all aspects other than that the following compounds (3b) and (4c) were used instead of the compounds (3a) and (4a), respectively. Next, an intermediate compound was yielded according to the same method as that for the intermediate compound of the hole transport material (HTM-1) in all aspects other than that a compound (5c) was used instead of the compound (5a). Thereafter, the hole transport material (HTM-3) (percentage yield 55% by mole) was yielded according to the same method as that for the hole transport material (HTM-1) in all aspects other than that the compound (5a) was used instead of the compound (5h).

(3b)

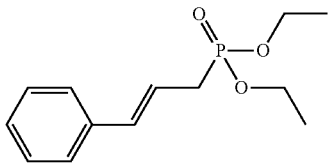

(4c)

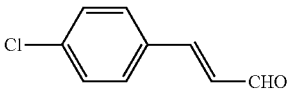

-continued (5c)

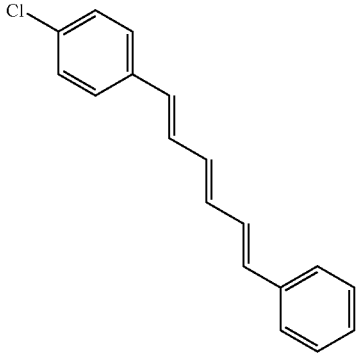

[Synthesis of Hole Transport Material (HTM-4)]

An intermediate compound was yielded according to the same method as that for the intermediate compound of the hole transport material (HTM-1). Thereafter, the hole transport material (HTM-4) (percentage yield 55% by mole) was yielded according to the same method as that for the hole transport material (HTM-1) in all aspects other than that the compound (5c) was used instead of the compound (5h).

[Synthesis of Hole Transport Material (HTM-5)]

An intermediate compound was yielded according to the same method as that for the intermediate compound of the hole transport material (HTM-1) in all aspects other than that a compound (5b) was used instead of the compound (5a). Thereafter, the hole transport material (HTM-5) (percentage yield 60% by mole) was yielded according to the same method as that for the hole transport material (HTM-1) in all aspects other than that the compound (5c) was used instead of the compound (5h).

[Synthesis of Hole Transport Material (HTM-6)]

An intermediate compound was yielded according to the same method as that for the intermediate compound of the hole transport material (HTM-1) in all aspects other than that a compound (5b) was used instead of the compound (5a). Thereafter, the hole transport material (HTM-6) (percentage yield 70% by mole) was yielded according to the same method as that for the hole transport material (HTM-1) in all aspects other than that the compound (5a) was used instead of the compound (5h).

[Synthesis of Hole Transport Material (HTM-7)]

An intermediate compound was yielded according to the same method as that for the intermediate compound of the hole transport material (HTM-1) in all aspects other than that the compound (5c) was used instead of the compound (5a). Thereafter, the hole transport material (HTM-7) (percentage yield 57% by mole) was yielded according to the same method as that for the hole transport material (HTM-1) in all aspects other than that the compound (5b) was used instead of the compound (5h).

[Synthesis of Hole Transport Material (HTM-8)]

The following compound (5g) (percentage yield 75% by mole) was yielded according to the same method as that for the compound (5a) in all aspects other than that the following compound (4g) was used instead of the compound (4g). Next, an intermediate compound was yielded according to the same method as that for the intermediate compound of the hole transport material (HTM-1) in all aspects other than that the compound (5c) was used instead of the compound (5a). Thereafter, the hole transport material (HTM-8) (percentage yield 54% by mole) was yielded according to the same method as that for the hole transport material (HTM-1) in all aspects other than that the compound (5g) was used instead of the compound (5h).

(4g)

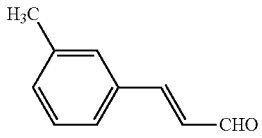

(5g)

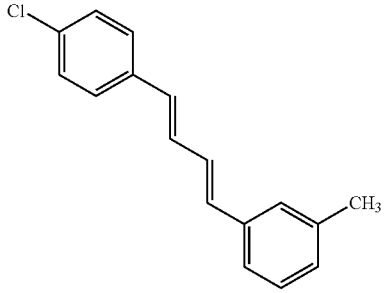

[Synthesis of Hole Transport Material (HTM-9)]

The following compound (5e) (percentage yield 70% by mole) was yielded according to the same method as that for the compound (5a) in all aspects other than that the following compound (4e) was used instead of the compound (4a). Next, an intermediate compound was yielded according to the same method as that for the intermediate compound of the hole transport material (HTM-1) in all aspects other than that the compound (5c) was used instead of the compound (5a). Thereafter, the hole transport material (HTM-9) (percentage yield 55% by mole) was yielded according to the same method as that for the hole transport material (HTM-1) in all aspects other than that the compound (5e) was used instead of the compound (5h).

(4e)

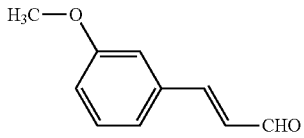

(5e)

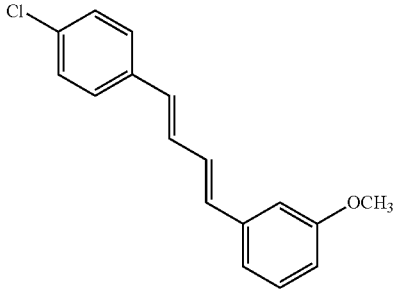

[Synthesis of Hole Transport Material (HTM-10)]

The following compound (5f) (percentage yield 65% by mole) was yielded according to the same method as that for synthesizing the compound (5h) in all aspects other than that the following compound (4f) was used instead of the compound (4h). Next, an intermediate compound was yielded according to the same method as that for the intermediate compound of the hole transport material (HTM-1) in all aspects other than that a compound (5f) was used instead of the compound (5a). Thereafter, a hole transport material (HTM-10) (percentage yield 60% by mole) was yielded according to the same method as that for the hole transport material (HTM-1) in all aspects other than that the compound (5a) was used instead of the compound (5h).

(4f)

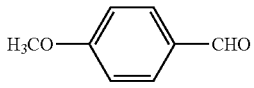

(5f)

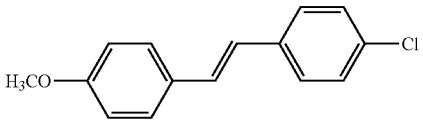

[1-3. Preparation of Electron Acceptor Compound]

For producing the photosensitive members (A-1)-(A-34) and (B-1)-(B-5), compounds represented by the following chemical formulas (EA-1)-(EA-11) (also referred to below as electron acceptor compounds (EA-1)-(EA-11)) were used as electron acceptor compounds.

(EA-1)

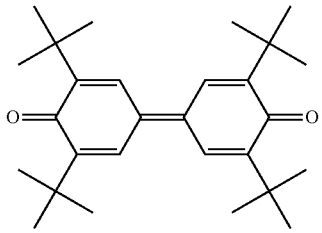

(EA-2)

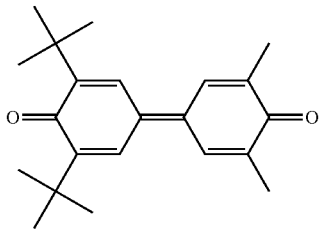

(EA-3)

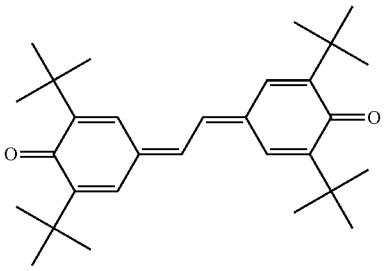

(EA-4)

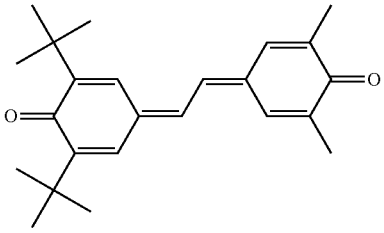

-continued (EA-5)

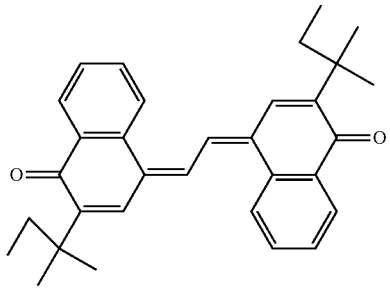

(EA-6)

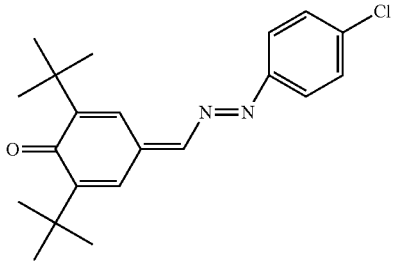

(EA-7)

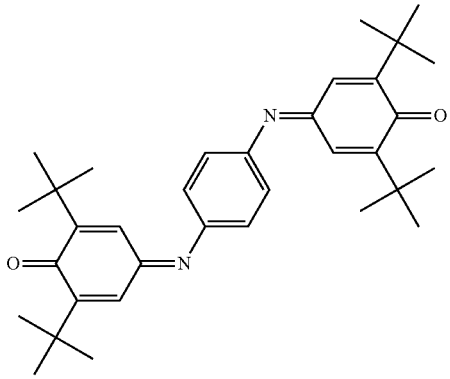

(EA-8)

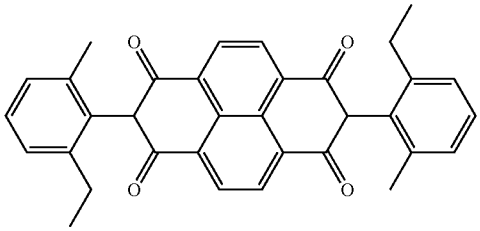

(EA-9)

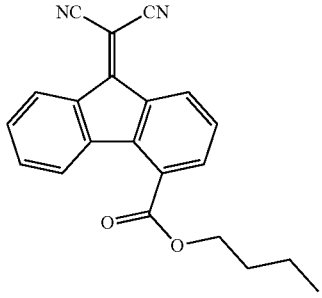

-continued (EA-10)

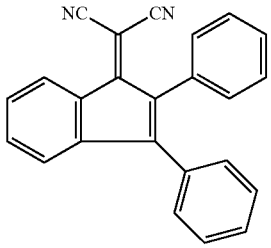

(EA-11)

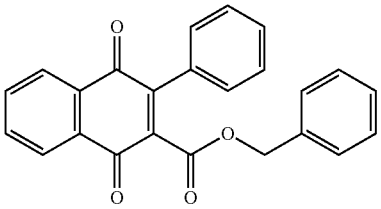

[1-4. Preparation of Binder Resin]

Polycarbonate resins (Resin-1)-(Resin-10) were used as binder resins for producing the photosensitive members (A-1)-(A-34) and (B-1)-(B-5). Note that the polycarbonate resins (Resin-1)-(Resin-10) have been already described in the first embodiment.

[2. Production of Photosensitive Member]

Example 1

(2-1. Formation of Undercoat Layer)

First, an application liquid for undercoat layer formation was prepared. Specifically, 2 parts by mass of titanium oxide that after surface treatment with alumina and silica, had been surface treated using methyl hydrogen polysiloxane during wet dispersion (test sample SMT-A produced by Tayca Corporation, number average primary particle size 10 nm) and 1 part by mass of nylon 6-12-66-610 quaterpolymer polyamide resin (Amilan (registered Japanese trademark) CM8000 produced by Toray Industries, Inc.) were mixed with a mixed solvent of 10 parts by mass of methanol, 1 part by mass of butanol, and 1 part by mass of toluene for 5 hours using a bead mill.

Then, an undercoat layer was formed. Specifically, a resultant application liquid for undercoat layer formation was filtered using a 5-μm filter and subsequently applied onto a drum-shaped aluminum support member as a conductive substrate by dip coating. The support member had a diameter of 30 mm and a total length of 246 mm. Through heat treatment at a temperature of 130° C. for 30 minutes, an undercoat layer having a film thickness of 2 μm was formed.

[2-2. Formation of Charge Generating Layer]

Subsequently, an application liquid for charge generating layer formation was prepared. Specifically, 1.5 parts by mass of the charge generating material (CG-1), 1 part by mass of a polyvinyl acetal resin (S-LEC BX-5 produced by Sekisui Chemical Co., Ltd.) as a base resin, 40 parts by mass of propylene glycol monomethyl ether as a dispersion medium, and 40 parts by mass of tetrahydrofuran were mixed and dispersed for two hours using a bead mill. Next, a resultant application liquid of charge generating layer formation was filtered using a 3-μm filter, applied onto the undercoat layer formed as above by dip coating, and subsequently dried at a temperature of 50° C. for five minutes to form a charge generating layer having a film thickness of 0.3 m.

[2-3. Formation of Charge Transport Layer]

Next, an application liquid for charge transport layer formation was prepared. Specifically, an application liquid for charge transport layer formation was prepared by mixing and dissolving 45 parts by mass of the hole transport material (HTM-1), 2 parts by mass of the electron acceptor compound (EA-1), 100 parts by mass of the polycarbonate resin (Resin-1) (viscosity average molecular weight 50,500) as a binder resin, 0.5 parts by mass of a phenolic antioxidant (IRGANOX (registered Japanese trademark) 1010 produced by BASF Japan Ltd.) as an additive, 560 parts by mass of tetrahydrofuran (THF) as a solvent, and 140 parts by mass of toluene. A ratio of the THF relative to the toluene (THF/toluene) was 8/2 (that is, 4).

The prepared application liquid for charge transport layer formation was applied onto the charge generating layer according to the same method as that for the application liquid for charge generating layer formation and dried at a temperature of 120° C. for 40 minutes to form a charge transport layer having a film thickness of 20 μm. Through the above processes, a multi-layer electrophotographic photosensitive member was produced. Note that the mass ratio of the hole transport material (HTM-1) relative to the polycarbonate resin (Resin-1) was 0.45 in the charge transport layer of the photosensitive member (A-1).

Example 2

The photosensitive member (A-2) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-2).

Example 3

The photosensitive member (A-3) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-3).

Example 4

The photosensitive member (A-4) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-4).

Example 5

The photosensitive member (A-5) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-5).

Example 6

The photosensitive member (A-6) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-6).

Example 7

The photosensitive member (A-7) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-7).

Example 8

The photosensitive member (A-8) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-8).

Example 9

The photosensitive member (A-9) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-9).

Example 10

The photosensitive member (A-10) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-10).

Example 11

The photosensitive member (A-11) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-2) (viscosity average molecular weight 50,500).

Example 12

The photosensitive member (A-12) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-3) (viscosity average molecular weight 50,500).

Example 13

The photosensitive member (A-13) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-4) (viscosity average molecular weight 50,500).

Example 14

The photosensitive member (A-14) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-5) (viscosity average molecular weight 50,500).

Example 15

The photosensitive member (A-15) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-6) (viscosity average molecular weight 50,500).

Example 16

The photosensitive member (A-16) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-7) (viscosity average molecular weight 50,500).

Example 17

The photosensitive member (A-17) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-8) (viscosity average molecular weight 50,500).

Example 18

The photosensitive member (A-18) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-9) (viscosity average molecular weight 50,500).

Example 19

The photosensitive member (A-19) was produced according to the same method as for the photosensitive member (A-8) in all aspects other than that 100 parts by mass of the polycarbonate resin (Resin-1) mixed and dissolved in the application liquid for charge transport layer formation was changed to 100 parts by mass of the polycarbonate resin (Resin-10) (viscosity average molecular weight 50,500).

Example 20

The photosensitive member (A-20) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-2).

Example 21

The photosensitive member (A-21) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-3).

Example 22

The photosensitive member (A-22) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-4).

Example 23

The photosensitive member (A-23) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-5).

Example 24

The photosensitive member (A-24) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-6).

Example 25

The photosensitive member (A-25) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-7).

Example 26

The photosensitive member (A-26) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-8).

Example 27

The photosensitive member (A-27) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-9).

Example 28

The photosensitive member (A-28) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-10).

Example 29

The photosensitive member (A-29) was produced according to the same method as for the photosensitive member (A-8) in all aspects other than that 2 parts by mass of the electron acceptor compound (EA-1) mixed and dissolved in the application liquid for charge transport layer formation was changed to 2 parts by mass of the electron acceptor compound (EA-1).

Example 30

The photosensitive member (A-30) was produced according to the same method as for the photosensitive member (A-8) in all aspects other than that the solvent used for preparing the application liquid for charge transport layer formation was changed from the mixed solution of THF (560 parts by mass) and toluene (140 parts by mass) to a mixed solvent of THF (560 parts by mass) and 1,4-dioxane (140 parts by mass). Note that a mass ratio of THF relative to 1.4-dioxane (THF/1.4-dioxane) was 8/2 (that is, 4).

Example 31

The photosensitive member (A-31) was produced according to the same method as for the photosensitive member (A-8) in all aspects other than that the solvent used for preparing the application liquid for charge transport layer formation was changed from the mixed solvent of THF (560 parts by mass) and toluene (140 parts by mass) to a mixed solution of THF (560 parts by mass) and o-xylene (140 parts by mass). Note that a mass ratio of THF relative to o-xylene (THF/o-xylene) was 8/2 (that is, 4).

Example 32

The photosensitive member (A-32) was produced according to the same method as for the photosensitive member (A-8) in all aspects other than that the content of the hole transport material (HTM-8) mixed and dissolved in the application liquid for charge transport layer formation was changed from 45 parts by mass to 55 parts by mass. Note that a mass ratio of the hole transport material (HTM-8) relative to the polycarbonate resin (Resin-1) in the charge transport layer of the photosensitive member (A-32) was 0.55.

Example 33

The photosensitive member (A-33) was produced according to the same method as for the photosensitive member (A-8) in all aspects other than that the content of the hole transport material (HTM-8) mixed and dissolved in the application liquid for charge transport layer formation was changed from 45 parts by mass to 35 parts by mass. Note that a mass ratio of the hole transport material (HTM-8) relative to the polycarbonate resin (Resin-1) in the charge transport layer of the photosensitive member (A-33) was 0.35.

Example 34

The photosensitive member (A-34) was produced according to the same method as for the photosensitive member (A-8) in all aspects other than that the content of the electron acceptor compound (EA-1) mixed and dissolved in the application liquid for charge transport layer formation was changed from 2 parts by mass to 0 parts by mass (that is, the electron acceptor compound (EA-1) was not used).

Comparative Example 1

The photosensitive member (B-1) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-11).

Comparative Example 2

The photosensitive member (B-2) was produced according to the same method as for the photosensitive member (A-1) in all aspects other than that 45 parts by mass of the hole transport material (HTM-1) mixed and dissolved in the application liquid for charge transport layer formation was changed to 45 parts by mass of the hole transport material (HTM-12).

Comparative Example 3

The photosensitive member (B-3) was produced according to the same method as for the photosensitive member (A-8) in all aspects other than that the content of the hole transport material (HTM-8) mixed and dissolved in the application liquid for charge transport layer formation was changed from 45 parts by mass to 64 parts by mass.

Note that a mass ratio of the hole transport material (HTM-8) relative to the polycarbonate resin (Resin-1) in the charge transport layer of the photosensitive member (B-3) was 0.64.

Comparative Example 4

The photosensitive member (B-4) was produced according to the same method as for the photosensitive member (A-8) in all aspects other than that the content of the hole transport material (HTM-8) mixed and dissolved in the application liquid for charge transport layer formation was changed from 45 parts by mass to 88 parts by mass. Note that a mass ratio of the hole transport material (HTM-8) relative to the polycarbonate resin (Resin-1) in the charge transport layer of the photosensitive member (B-4) was 0.88.

Comparative Example 5

The photosensitive member (B-5) was produced according to the same method as for the photosensitive member (A-8) in all aspects other than that the content of the hole transport material (HTM-8) mixed and dissolved in the application liquid for charge transport layer formation was changed from 45 parts by mass to 25 parts by mass. Note that a mass ratio of the hole transport material (HTM-8) relative to the polycarbonate resin (Resin-1) in the charge transport layer of the photosensitive member (B-5) was 0.25.

Tables 1-3 indicate a configuration of each of the photosensitive members (A-1)-(A-34) and (B-1)-(B-5). Note that the term "mass ratio" in Tables 1-3 means a mass ratio of a hole transport material relative to a binder resin in a charge transport material. In a situation for example in which 45 parts by mass of a hole transport material is contained relative to 100 parts by mass of a binder resin in a charge transport material, the mass ratio of the hole transport material is 0.45. In a situation in which a mixed solvent of a plurality of different types of mixed solvents was used, a mass ratio of the solvents was indicated in the column of solvent in addition to the types of the solvents.

TABLE 1

| Photosensitive member | Hole transport material Type | Mass ratio | Binder resin | Electron acceptor compound | Solvent |
|---|---|---|---|---|---|
| A-1 | HTM-1 | 0.45 | Resin-1 | EA-1 | THF/Toluene = 8/2 |
| A-2 | HTM-2 | 0.45 | Resin-1 | EA-1 | THF/Toluene = 8/2 |
| A-3 | HTM-3 | 0.45 | Resin-1 | EA-1 | THF/Toluene = 8/2 |
| A-4 | HTM-4 | 0.45 | Resin-1 | EA-1 | THF/Toluene = 8/2 |
| A-5 | HTM-5 | 0.45 | Resin-1 | EA-1 | THF/Toluene = 8/2 |
| A-6 | HTM-6 | 0.45 | Resin-1 | EA-1 | THF/Toluene = 8/2 |
| A-7 | HTM-7 | 0.45 | Resin-1 | EA-1 | THF/Toluene = 8/2 |
| A-8 | HTM-8 | 0.45 | Resin-1 | EA-1 | THF/Toluene = 8/2 |
| A-9 | HTM-9 | 0.45 | Resin-1 | EA-1 | THF/Toluene = 8/2 |
| A-10 | HTM-10 | 0.45 | Resin-1 | EA-1 | THF/Toluene = 8/2 |
| A-11 | HTM-8 | 0.45 | Resin-2 | EA-1 | THF/Toluene = 8/2 |
| A-12 | HTM-8 | 0.45 | Resin-3 | EA-1 | THF/Toluene = 8/2 |
| A-13 | HTM-8 | 0.45 | Resin-4 | EA-1 | THF/Toluene = 8/2 |
| A-14 | HTM-8 | 0.45 | Resin-5 | EA-1 | THF/Toluene = 8/2 |
| A-15 | HTM-8 | 0.45 | Resin-6 | EA-1 | THF/Toluene = 8/2 |
| A-16 | HTM-8 | 0.45 | Resin-7 | EA-1 | THF/Toluene = 8/2 |
| A-17 | HTM-8 | 0.45 | Resin-8 | EA-1 | THF/Toluene = 8/2 |
| A-18 | HTM-8 | 0.45 | Resin-9 | EA-1 | THF/Toluene = 8/2 |
| A-19 | HTM-8 | 0.45 | Resin-10 | EA-1 | THF/Toluene = 8/2 |

TABLE 2

| Photosensitive member | Hole transport material Type | Mass ratio | Binder resin | Electron acceptor compound | Solvent |
|---|---|---|---|---|---|
| A-20 | HTM-8 | 0.45 | Resin-1 | EA-2 | THF/Toluene = 8/2 |
| A-21 | HTM-8 | 0.45 | Resin-1 | EA-3 | THF/Toluene = 8/2 |
| A-22 | HTM-8 | 0.45 | Resin-1 | EA-4 | THF/Toluene = 8/2 |
| A-23 | HTM-8 | 0.45 | Resin-1 | EA-5 | THF/Toluene = 8/2 |
| A-24 | HTM-8 | 0.45 | Resin-1 | EA-6 | THF/Toluene = 8/2 |
| A-25 | HTM-8 | 0.45 | Resin-1 | EA-7 | THF/Toluene = 8/2 |
| A-26 | HTM-8 | 0.45 | Resin-1 | EA-8 | THF/Toluene = 8/2 |
| A-27 | HTM-8 | 0.45 | Resin-1 | EA-9 | THF/Toluene = 8/2 |
| A-28 | HTM-8 | 0.45 | Resin-1 | EA-10 | THF/Toluene = 8/2 |
| A-29 | HTM-8 | 0.45 | Resin-1 | EA-11 | THF/Toluene = 8/2 |
| A-30 | HTM-8 | 0.45 | Resin-1 | EA-1 | THF/1,4-dioxane = 8/2 |
| A-31 | HTM-8 | 0.45 | Resin-1 | EA-1 | THF/o-xylene = 8/2 |
| A-32 | HTM-8 | 0.55 | Resin-1 | EA-1 | THF/Toluene = 8/2 |
| A-33 | HTM-8 | 0.35 | Resin-1 | EA-1 | THF/Toluene = 8/2 |
| A-34 | HTM-8 | 0.45 | Resin-1 | — | THF/Toluene = 8/2 |

TABLE 3

| Photosensitive member | Hole transport material Type | Mass ratio | Binder resin | Electron acceptor compound | Solvent |
|---|---|---|---|---|---|
| B-1 | HTM-11 | 0.45 | Resin-1 | EA-1 | THF/Toluene = 8/2 |
| B-2 | HTM-12 | 0.45 | Resin-1 | EA-1 | THF/Toluene = 8/2 |
| B-3 | HTM-8 | 0.64 | Resin-1 | EA-1 | THF/Toluene = 8/2 |
| B-4 | HTM-8 | 0.88 | Resin-1 | EA-1 | THF/Toluene = 8/2 |
| B-5 | HTM-8 | 0.25 | Resin-1 | EA-1 | THF/Toluene = 8/2 |

[3. Measuring Methods]

(3-1. Method for Measuring X-Ray Diffraction Spectrum of Charge Generating Material)

A sample (Y-form titanyl phthalocyanine crystals) was loaded into a sample holder of an X-ray diffraction spectrometer (RINT (registered Japanese trademark) 1100 produced by Rigaku Corporation) and an X-ray diffraction spectrum was measured under the following conditions.

X-ray tube: Cu.

Tube voltage: 40 kV.

Tube current: 30 mA.

Wavelength of CuKα characteristic X-ray: 1.542 Å.

Measurement range (2θ): at least 3° and no greater than 40° (start angle 3°, stop angle 40°).

Scanning speed: 10°/minute.

A main peak was determined from the obtained CuKα characteristic X-ray diffraction spectrum, and the Bragg angle of the main peak was read.

(3-2. Method for Measuring Differential Scanning Calorimetry Spectrum of Charge Generating Material)

An evaluation sample of a crystal powder (titanyl phthalocyanine) was loaded on a sample pan, and a differential scanning calorimetry spectrum was measured using a differential scanning calorimeter (TAS-200 DSC 8230D produced by Rigaku Corporation) under the following conditions.

Measurement range: at least 40° C. and no greater than 400° C.

Heating rate: 20° C./minute.

[4. Performance Evaluation of Photosensitive Member]

(4-1. Evaluation of Electrical Characteristics of Photosensitive Member)

(Measurement of Charge Potential $V_0$)

An electrical properties tester (product of GENTEC) was used as an evaluation apparatus. Each of the photosensitive members was set on the electrical properties tester. The surface potential of the photosensitive member at a rotational speed of 31 rpm and at an electric current flowing into drum of −10 μA was measured under a low-temperature and low-humidity environment (temperate 10° C., humidity 20% RH). The measured surface potential of the photosensitive member was defined as a charge potential $V_0$.

(Measurement of Sensitivity Potential $V_L$)

The photosensitive member was charged at a voltage of −600 V and exposed using exposure light having a wavelength of 780 nm at an exposure dose of 0.26 μJ/cm$^2$ for 50 microseconds. A surface potential of the photosensitive member thereafter was measured under a low-temperature and low-humidity environment (temperature 10° C., humidity 20% RH) using an electrical properties tester produced by GENTEC. The measured surface potential was defined as a sensitivity potential $V_L$.

(4-2. Evaluation of Abrasion Resistance of Photosensitive Member (Abrasion Evaluation Test))

An application liquid for charge transport layer formation was applied onto a polypropylene sheet having a thickness of 0.3 mm wound around an aluminum pipe having a diameter of 780 mm. The applied film was dried at a temperature of 120° C. for 40 minutes to form a charge transport layer having a film thickness of 30 μm on the polypropylene sheet. The resultant charge transport layer was peeled off from the polypropylene sheet and attached to a wheel (S-36 produced by TABER Industries) to prepare a sample for abrasion resistance evaluation. A 1,000-rotation abrasion test was performed on the prepared sample by a rotary abrasion tester (produced by Toyo Seiki Co., Ltd.), using an abrasion wheel C-10 (produced by TABER Industries), a 750 gf load, and a 60 rpm rotation speed. The mass of the sample was measured prior to and after the abrasion test. The abrasion loss (mg/1,000 rotations) was measured as a difference between the mass of the sample charge transport layer prior to the abrasion test and the mass of the sample charge transport layer after the abrasion test.

Results of evaluation of electrical characteristics and abrasion resistance of the photosensitive members are indicated in Tables 4-6.

TABLE 4

| Photosensitive member | Electrical characteristics $V_0$ (V) | $V_L$ (V) | Abrasion resistance Abrasion loss (mg) |
|---|---|---|---|
| A-1 | −766 | −60 | 4.5 |
| A-2 | −795 | −67 | 6.2 |
| A-3 | −781 | −68 | 5.5 |
| A-4 | −815 | −54 | 5.1 |
| A-5 | −839 | −64 | 5.6 |
| A-6 | −774 | −59 | 5.7 |
| A-7 | −751 | −67 | 5.6 |
| A-8 | −775 | −61 | 4.6 |
| A-9 | −780 | −61 | 6.1 |
| A-10 | −820 | −67 | 5.6 |
| A-11 | −806 | −69 | 4.9 |
| A-12 | −827 | −66 | 5.1 |
| A-13 | −774 | −63 | 5.4 |
| A-14 | −791 | −62 | 5.5 |
| A-15 | −801 | −61 | 5.6 |
| A-16 | −800 | −68 | 7.5 |
| A-17 | −851 | −75 | 5.6 |
| A-18 | −799 | −74 | 7.5 |
| A-19 | −781 | −79 | 7.4 |

TABLE 5

| Photosensitive member | Electrical characteristics $V_0$ (V) | $V_L$ (V) | Abrasion resistance Abrasion loss (mg) |
|---|---|---|---|
| A-20 | −785 | −68 | 5.1 |
| A-21 | −835 | −61 | 5.6 |
| A-22 | −828 | −61 | 4.9 |
| A-23 | −784 | −65 | 6.3 |
| A-24 | −799 | −69 | 5.6 |
| A-25 | −778 | −69 | 6.3 |
| A-26 | −815 | −69 | 6.4 |
| A-27 | −774 | −56 | 6.1 |
| A-28 | −806 | −59 | 5.5 |
| A-29 | −817 | −65 | 5.9 |
| A-30 | −773 | −62 | 5.9 |
| A-31 | −773 | −67 | 6.1 |
| A-32 | −823 | −52 | 6.5 |
| A-33 | −779 | −67 | 5.1 |
| A-34 | −801 | −64 | 6.4 |

TABLE 6

| Photosensitive member | Electrical characteristics $V_0$ (V) | $V_L$ (V) | Abrasion resistance Abrasion loss (mg) |
|---|---|---|---|
| B-1 | −823 | −115 | 5.6 |
| B-2 | −779 | −125 | 5.8 |
| B-3 | −796 | −46 | 9.1 |
| B-4 | −750 | −40 | 8.5 |
| B-5 | −792 | −50 | 100 |

As indicated in Tables 1 and 2, the photosensitive members (A-1)-(A-34) each contained the charge generating material (CG-1) in the charge generating layer. The charge generating material (CG-1) was a titanyl phthalocyanine exhibiting a main peak at a Bragg angle (2θ±0.2°) of 27.2° in a CuKα characteristic X-ray diffraction spectrum. Furthermore, the photosensitive members (A-1)-(A-34) each contained any one of the hole transport materials (HTM-1)-(HTM-10) in the charge transport layer. The photosensitive members (A-1)-(A-34) each had a mass ratio of the hole transport material of at least 0.30 and no greater than 0.55 relative to the binder resin in the charge transport layer.

As indicated in Table 3, the photosensitive members (B-1)-(B-5) each contained the charge generating material (CG-1) in the charge generating layer. The charge generating material (CG-1) was a titanyl phthalocyanine exhibiting a main peak at a Bragg angle (2θ±0.2°) of 27.2° in a CuKα characteristic X-ray diffraction spectrum. Furthermore, the photosensitive members (B-1)-(B-5) each contained the polycarbonate resin (Resin-1) as a binder resin and any one of the hole transport materials (HTM-8), (HTM-11), and (HTM-12) in the charge transport layer. The mass ratio of the hole transport material was at least 0.25 and no greater than 0.88 relative to the polycarbonate resin in the charge transport layer of each of the photosensitive members (B-1)-(B-5). Specifically, the respective hole transport materials (HTM-11) and (HTM-12) in the photosensitive members (B-1) and (B-2) were not the triarylamine derivative represented by general formula (1). The mass ratio of the hole transport material represented by general formula (1) relative to the polycarbonate resin did not fall in a range of at least 0.30 and no greater than 0.55 in each of the photosensitive members (B-3)-(B-5).

As indicated in Tables 4 and 5, the photosensitive members (A-1)-(A-34) each had a charge potential $V_0$ of at least −839 V and no greater than −751 V and a sensitivity potential $V_L$ of at least −69 V and no greater than −52 V in evaluation of electrical characteristics. Furthermore, the photosensitive members (A-1)-(A-34) each had an abrasion loss of at least 4.5 mg and no greater than 7.5 mg in evaluation of abrasion resistance.

As indicated in Table 6, the photosensitive members (B-1) and (B-2) each had a sensitivity potential $V_L$ of at least −125 V and no greater than −115 V in evaluation of electrical characteristics. From the above results, it was shown that the photosensitive members (B-1) and (B-2) were poor in electrical characteristics. Further, the photosensitive members (B-3)-(B-5) each had an abrasion loss of at least 8.5 mg and no greater than 10.0 mg in evaluation of the abrasion resistance. From the above results, it was shown that the photosensitive members (B-3)-(B-5) were poor in abrasion resistance.

From the above results, the photosensitive members (A-1)-(A-34) (the photosensitive member according to the first embodiment) were excellent in both electrical characteristics and abrasion resistance when compared with the photosensitive members (B-1)-(B-5) (photosensitive members of the comparative examples).

What is claimed is:

1. A multi-layer electrophotographic photosensitive member comprising a conductive substrate and a photosensitive layer, wherein the photosensitive layer includes a charge generating layer that contains a charge generating material and a charge transport layer that contains a hole transport material, an electron acceptor compound, and a binder resin, the charge generating material contains a titanyl phthalocyanine that exhibits a peak at a Bragg angle (2θ±0.2°) of 27.2° in a CuKα characteristic X-ray diffraction spectrum, the hole transport material contains a triarylamine derivative represented by generic formula (1) shown below, the hole transport material has a mass ratio of at least 0.30 and no greater than 0.55 relative to the binder resin in the charge transport layer, and the electron acceptor compound contains a compound represented by the following chemical formula (EA-7), (EA-8), (EA-9), (EA-10), or (EA-11), (1)

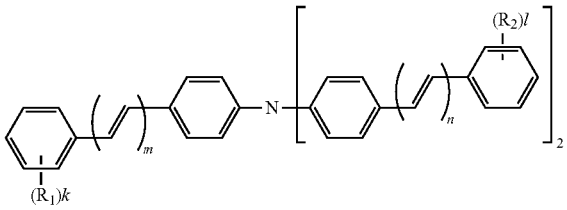

where in the general formula (1), $R_1$ and $R_2$ represent, independently of one another, a halogen atom, an optionally substituted alkyl group having a carbon number of at least 1 and no greater than 6, an optionally substituted alkoxy group having a carbon number of at least 1 and no greater than 6, or an optionally substituted aryl group having a carbon number of at least 6 and no greater than 12, k and l represent, independently of one another, an integer of at least 0 and no greater than 4, when k represents an integer greater than 1, a plurality of chemical groups $R_1$ bonded to the same aromatic ring are the same as or different from one another, when l represents an integer greater than 1, a plurality of chemical groups $R_2$ bonded to the same aromatic ring are the same as or different from one another, m and n represent, independently of one another, an integer of at least 1 and no greater than 3, and m and n represent integers different from one another:

(EA-7)

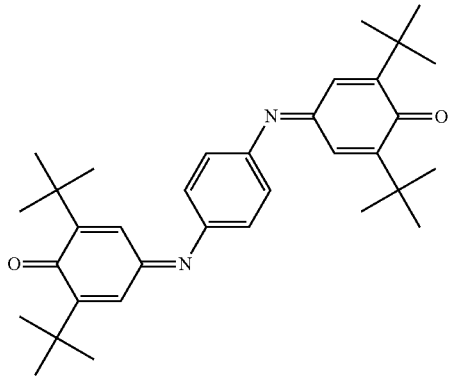

(EA-8)

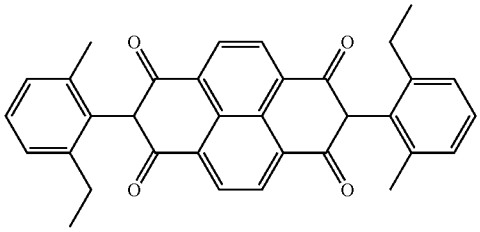

(EA-9)

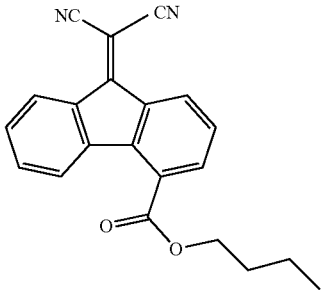

(EA-10)

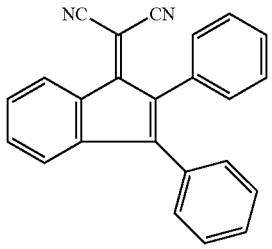

(EA-11)

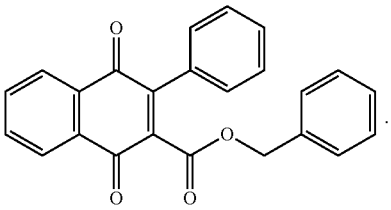

2. The multi-layer electrophotographic photosensitive member according to claim 1, wherein in the general formula (1), $R_1$ represents an alkyl group having a carbon number of at least 1 and no greater than 3 or an alkoxy group having a carbon number of at least 1 and no greater than 3, $R_2$ represents an alkoxy group having a carbon number of at least 1 and no greater than 3, and k and l represent, independently of one another, 0 or 1.

3. The multi-layer electrophotographic photosensitive member according to claim 1, wherein the hole transport material contains at least one of compounds represented by chemical formulas (HTM-1)-(HTM-10) shown below:

(HTM-1)

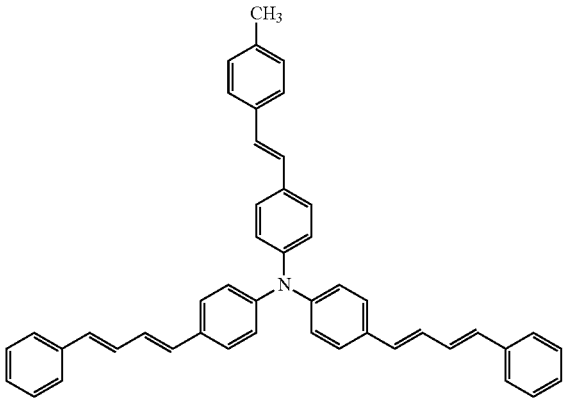

(HTM-2)

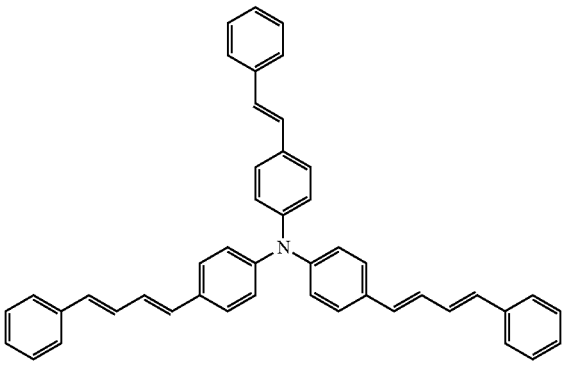

(HTM-3)

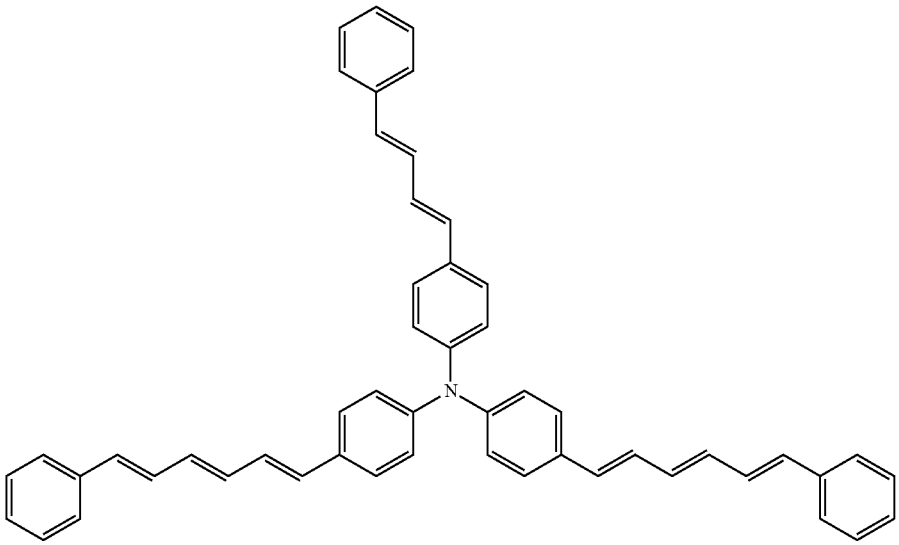

(HTM-4)

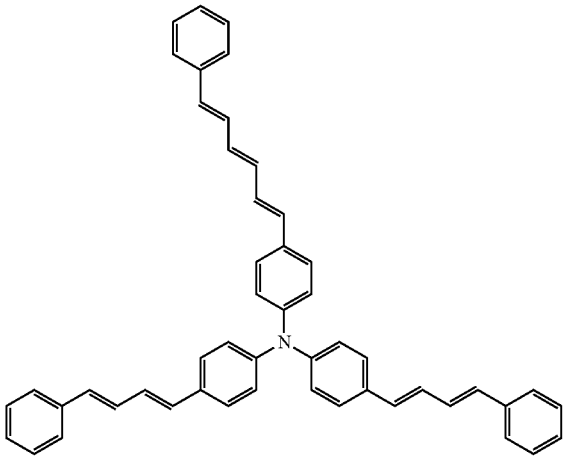

(HTM-5)

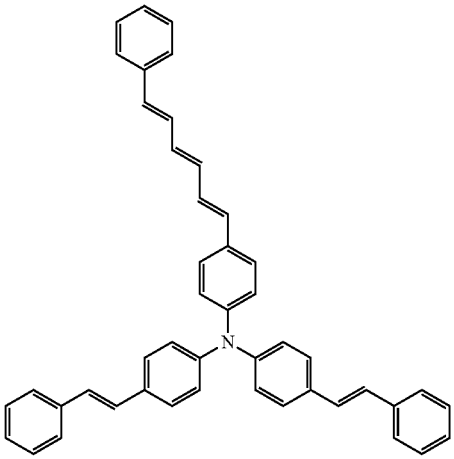

-continued
(HTM-6)
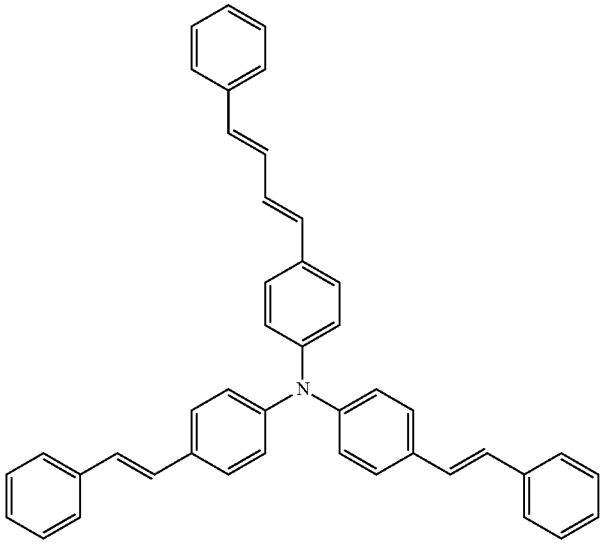
(HTM-7)
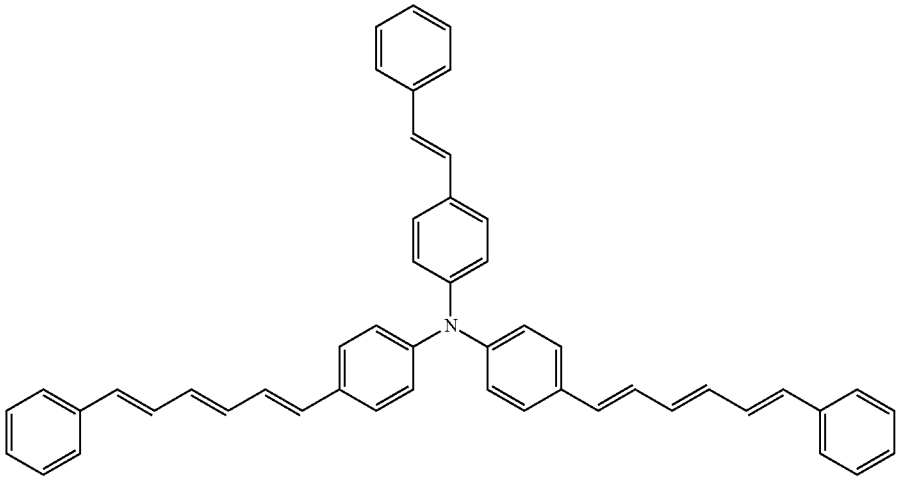
(HTM-8)
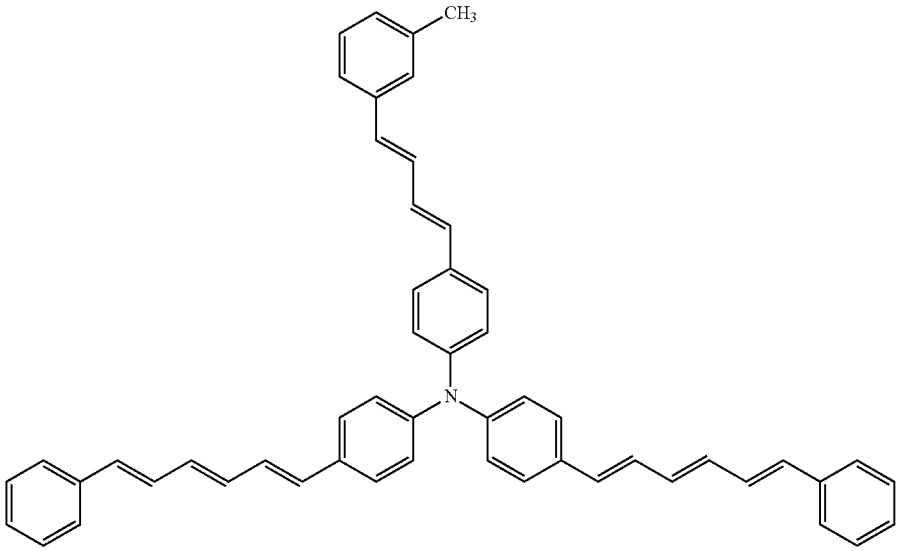

-continued (HTM-9)

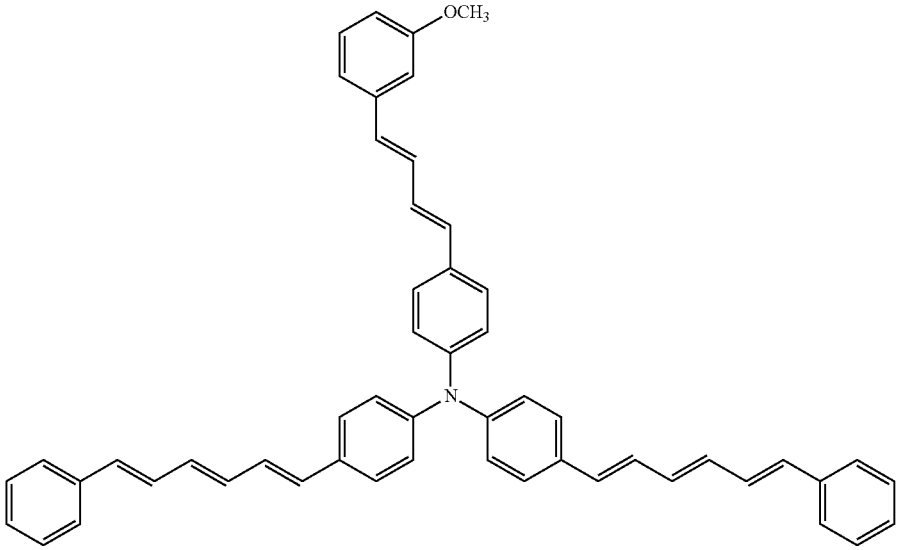

(HTM-10)

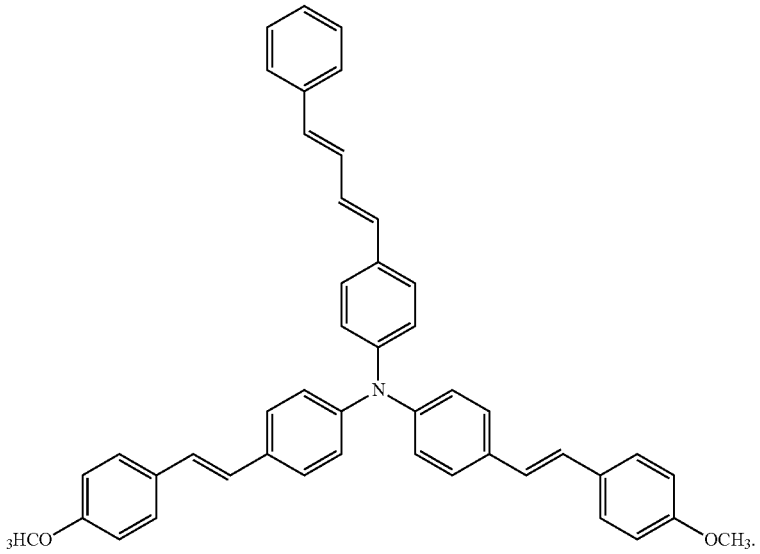

4. The multi-layer electrophotographic photosensitive member according to claim 1, wherein the binder resin contains a polycarbonate resin represented by general formula (2) shown below, (2)

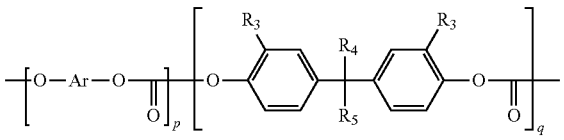

where in the general formula (2),

Ar represents a divalent group represented by general formula (2-1), (2-2), or (2-3), or chemical formula (2-4), $R_3$, $R_4$, and $R_5$ represent, independently of one another, a hydrogen atom, an alkyl group, or an aryl group, $R_4$ and $R_5$ are optionally bonded to one another to form a ring of a cycloalkylidene group, and $p+q=1.00$ and $0.35 \leq q < 0.70$, (2-1)

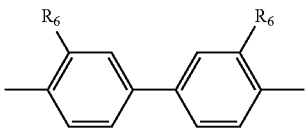

(2-2)

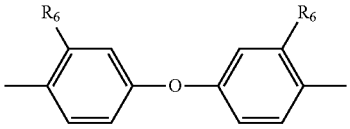

-continued (2-3)

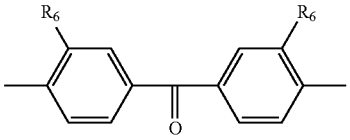

(2-4)

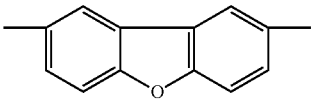

where in the general formulas (2-1), (2-2), and (2-3), $R_6$ represents a hydrogen atom, an alkyl group, or an aryl group.

5. The multi-layer electrophotographic photosensitive member according to claim 4, wherein in the general formula (2), $R_3$ represents a hydrogen atom, and $R_4$ and $R_5$ are optionally bonded to one another to form a ring of a cyclohexylidene group or cyclopentylidene group, or $R_4$ and $R_5$ represent a methyl group and an ethyl group, respectively, and in the general formulas (2-1), (2-2), and (2-3), $R_6$ represents a hydrogen atom.

6. A process cartridge comprising the multi-layer electrophotographic photosensitive member according to claim 1.

7. An image forming apparatus comprising:

an image bearing member;

a charger configured to charge a surface of the image bearing member;

a light exposure section configured to form an electrostatic latent image on the charged surface of the image bearing member;

a development section configured to develop the electrostatic latent image into a toner image; and a transfer section configured to transfer the toner image to a transfer target from the image bearing member, wherein the image bearing member is the multi-layer electrophotographic photosensitive member according to claim 1.

8. The multi-layer electrophotographic photosensitive member according to claim 1, wherein the electron acceptor compound contains the compound represented by the chemical formula (EA-9) or (EA-10).

* * * * *